US006476767B2

(12) United States Patent
Aoyama et al.

(10) Patent No.: US 6,476,767 B2
(45) Date of Patent: Nov. 5, 2002

(54) CHIP ANTENNA ELEMENT, ANTENNA APPARATUS AND COMMUNICATIONS APPARATUS COMPRISING SAME

(75) Inventors: Hiroyuki Aoyama, Saitama-ken (JP); Kenichi Tonomura, Gumna-ken (JP); Keiko Kikuchi, Saitama-ken (JP); Yuta Sugiyama, Lajoll, CA (US)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/833,560

(22) Filed: Apr. 13, 2001

(65) Prior Publication Data

US 2001/0050637 A1 Dec. 13, 2001

(30) Foreign Application Priority Data

Apr. 14, 2000 (JP) ..... 2000-113686
Nov. 20, 2000 (JP) ..... 2000-353460
Feb. 21, 2001 (JP) ..... 2001-45354

(51) Int. Cl.[7] ..... H01Q 1/38
(52) U.S. Cl. ..... 343/700 MS; 343/702
(58) Field of Search ..... 343/700 MS, 702, 343/873, 846, 848; H01Q 1/38, 1/24

(56) References Cited

U.S. PATENT DOCUMENTS 5,696,517 A 12/1997 Kawahata et al. ..... 343/700
5,861,854 A 1/1999 Kawahata et al. ..... 343/702
6,297,777 B1 * 10/2001 Tsubaki et al. ..... 343/700 MS
6,300,909 B1 * 10/2001 Tsubaki et al. ..... 343/700 MS
6,323,811 B1 * 11/2001 Tsubaki et al. ..... 343/700 MS

FOREIGN PATENT DOCUMENTS

| | | |
|---|---|---|
| EP | 1 003 240 A2 | 5/2000 |
| JP | 10-107535 | 4/1998 |
| JP | 10-209740 | 8/1998 |
| JP | 11-251816 | 9/1999 |

OTHER PUBLICATIONS

European Patent Office Search Report dated Aug. 20, 2001.
K. Kazuya, "Surface Mount Antenna", Patent Abstracts of Japan of JP 10107535, published Apr. 24, 1998.

* cited by examiner

*Primary Examiner*—Hoanganh Le
(74) *Attorney, Agent, or Firm*—Finnegan, Henderson, Farabow, Garrett & Dunner, L.L.P.

(57) ABSTRACT

A chip antenna element comprises (a) a radiation electrode formed on at least one surface of an insulating substrate, such that the radiation electrode extends from a first end of the substrate or its vicinity to a second end of the substrate or its vicinity, with a width decreasing substantially continuously and/or stepwise, thereby having a wide rear end on the side of the first end of the substrate and a narrow tip end on the side of the second end of the substrate, (b) a first grounding electrode connecting directly or via a gap to the rear end of the radiation electrode, (c) a second grounding electrode opposing the tip end of the radiation electrode via a gap, and (d) a feeding electrode formed on at least one surface of the substrate at a position facing an intermediate point of the radiation electrode, with or without contact with the radiation electrode.

32 Claims, 21 Drawing Sheets

CHIP ANTENNA ELEMENT, ANTENNA APPARATUS AND COMMUNICATIONS APPARATUS COMPRISING SAME

FIELD OF THE INVENTION

The present invention relates to a microstrip-line chip antenna element suitable for microwave wireless communications apparatuses such as portable wireless phones and wireless local area network LAN, and an antenna apparatus comprising such a chip antenna element and a communications apparatus comprising such an antenna apparatus.

PRIOR ART

In microwave wireless communications apparatuses, particularly portable communications apparatuses such as cellular phones, monopole antennas and microstrip-line antennas are generally used for achieving miniaturization and reduction in thickness. A microstrip-line antenna element put into practical use at present has, as described in Japanese Patent Laid-Open No. 10-209740, a radiation electrode formed on an upper surface of a dielectric, rectangular parallelepiped body, high-frequency electric signal being fed from below. FIG. 36 schematically shows the structure of this microstrip-line antenna element. When operated as an antenna, the antenna element is mounted onto a printed circuit board having a ground conductor 96, and a feeding line 94 is disposed on a lower surface of the printed circuit board. An electric line force F is generated between an open end 91 of a radiation electrode 90 and the ground conductor 96, whereby a magnetic flux is generated in a perpendicular direction to the radiation electrode 90, efficiently emitting electromagnetic wave to the space. The length D of the radiation electrode 90 is usually about ¼ of a wavelength, generating a magnetic flux in a perpendicular direction to the radiation electrode 90 at resonance, the direction of an electric line force F being in perpendicular to the magnetic flux emitted from the end surface 91 of the radiation electrode 90. With respect to the shape of the radiation electrode 90 in a plan view, various shapes such as circle, pentagon, etc. are proposed in addition to rectangle, though vertically or horizontally symmetric shapes are mostly used.

Antennas used for portable communications apparatuses should be small, efficient in radiation and substantially omni-directional. For this purpose, a small antenna element has a structure in which a radiation electrode is disposed on an upper surface or inside of an insulating substrate, because the wavelength of electric current flowing through the radiation electrode is made shorter by influence of the insulating substrate. Because the same radiation effect can be kept even though the radiation electrode is made shorter, the antenna can be miniaturized. The necessary length d of the antenna is represented by the following equation (1):

$$d=c/(2f_0\sqrt{\in r}) \quad (1),$$

wherein $\in r$ is a specific dielectric constant of the insulating substrate, $f_0$ is a resonance frequency, and c is the velocity of light.

As is clear from the equation (1), the length d of an antenna element having a microstrip-line structure can be made shorter as the insulating substrate has a larger specific dielectric constant $\in r$ at a constant resonance frequency $f_0$. In other words, with a substrate having a high specific dielectric constant $\in r$, a small microstrip-line antenna element can be obtained with the same performance. Because a small antenna element is indispensable particularly for cellular phones, etc., the development of smaller, high-performance antenna elements has been desired.

There is an inverted F antenna as an antenna applicable to portable communications apparatuses other than the microstrip-line antenna. The inverted F antenna is constituted by an F-shaped antenna conductor comprising a bent portion at an end connected to a ground conductor plate, a center bent portion connected to a feeding line via a gap. Because the antenna conductor needs only to be as long as about ¼ of a wavelength, it may be regarded as an antenna having a shape obtained by laterally expanding the microstrip-line antenna element.

The conventional microstrip-line antenna element has the following disadvantages in miniaturization. That is, when the radiation electrode is made smaller by increasing the specific dielectric constant $\in r$ of an insulating substrate, a resonance bandwidth of the resonance frequency $f_0$ becomes narrower, whereby the antenna is operable only in a narrow frequency range.

This means the restriction of a frequency range available for communications, not preferable for antenna for cellular phones, etc. Accordingly, to develop a practically useful antenna, it should have wide bandwidth characteristics. Particularly in multi-frequency antennas using two or more frequencies, the phenomenon of narrowing a bandwidth is a serious problem, which cannot be controlled only by the properties of the insulating substrate.

A resonance bandwidth BW, a resonance frequency $f_0$ and a Q value representing the performance of an antenna at resonance meet the following relation:

$$BW=f_0/Q \quad (2).$$

The height H a microstrip-line antenna element equal to the thickness of its insulating substrate and the Q value meet the following relation:

$$Q \in r/H \quad (3).$$

Known as a small microstrip-line antenna is an antenna having a radiation electrode divided to two parts at center, one end of the divided radiation electrode is electrically connected to a ground conductor plate (Hiroyuki Arai, "New Antenna Engineering," Sogo-Densi Shuppan, pp. 109–112). Because the length of the radiation electrode is about ¼ of a wavelength at resonance frequency, this antenna is as small as about 50% of the conventional antenna.

Japanese Patent Laid-Open No. 11-251816 discloses a microstrip-line antenna element operable at an expanded bandwidth with a radiation electrode formed on an edge region (adjacent two surfaces) of the substrate. When this microstrip-line antenna element is assembled in a portable communications apparatus, however, a radio wave emitted mainly from the end of the radiation electrode induces electric current in a nearby casing or in conductors on the circuit board, making the current-induced conductors function as an apparent antenna. Thus, the characteristics of this antenna is variable depending on ambient environment, causing impedance mismatching at a feed point and the variation of radiation directivity.

Further, because electronic circuit parts mounted near the antenna element are affected by a high-frequency electromagnetic wave emitted from the end of the radiation electrode, there arise problems of deteriorating communications performance such as noises, errors, irregular oscillation, etc. Conventional means for coping with such problems was to fully separate nearby circuit parts from the antenna element, failing to increase the mounting density of parts near the antenna, thus largely hindering the miniaturization of communications apparatuses.

OBJECT OF THE INVENTION

Accordingly, an object of the present invention is to provide a small microstrip-line antenna element having a sufficient Q value with high gain and broad bandwidth.

Another object of the present invention is to provide an antenna apparatus comprising such an antenna element mounted onto a circuit board with improved mounting density without affecting nearby parts.

A further object of the present invention is to provide a communications apparatus such as a portable information terminal, etc. comprising such an antenna apparatus.

SUMMARY OF THE INVENTION

As a result of investigation by simulation to achieve the miniaturization and increase in bandwidth of an antenna element, it has been found: (1) the antenna element can equivalently be provided with a plurality of resonance circuits by properly designing the shapes of a radiation electrode go and grounding electrodes; (2) radiation directivity can be achieved with high gain and without unnecessary field emission by properly designing the arrangement of electrodes; and (3) an area occupied by the antenna can be reduced while providing good antenna characteristics by properly designing the mounting of an antenna onto a ground conductor. The present invention is based on these findings.

Thus, the chip antenna element of the present invention comprises an insulating substrate and a radiation electrode formed on at least one surface of the insulating substrate, the radiation electrode extending from a first end of the substrate or its vicinity to a second end of the substrate or its vicinity, with a width decreasing substantially continuously and/or stepwise.

The chip antenna element according to one embodiment of the present invention comprises (a) a grounding electrode formed on a first end surface and/or a nearby surface region of an insulating substrate, (b) a radiation electrode formed on at least one surface of the substrate, such that the radiation electrode extends from the grounding electrode with or without a gap to a second end of the substrate or its vicinity, with a width decreasing substantially continuously and/or stepwise, thereby having a wide rear end on the side of the first end of the substrate and a narrow tip end on the side of the second end of the substrate, and (c) a feeding electrode formed on at least one surface of the substrate at a position facing an intermediate point of the radiation electrode, with or without contact with the radiation electrode.

The chip antenna element according to another embodiment of the present invention comprises (a) a radiation electrode formed on at least one surface of an insulating substrate, such that the radiation electrode extends from a first end of the substrate or its vicinity to a second end of the substrate or its vicinity, with a width decreasing substantially continuously and/or stepwise, thereby having a wide rear end on the side of the first end of the substrate and a narrow tip end on the side of the second end of the substrate, and (b) a grounding electrode opposing the tip end of the radiation electrode via a gap, and (c) a feeding electrode formed on at least one surface of the substrate at a position facing an intermediate point of the radiation electrode, with or without contact with the radiation electrode.

The chip antenna element according to a further embodiment of the present invention comprises (a) a radiation electrode formed on at least one surface of an insulating substrate, such that the radiation electrode extends from a first end of the substrate or its vicinity to a second end of the substrate or its vicinity, with a width decreasing substantially continuously and/or stepwise, thereby having a wide rear end on the side of the first end of the substrate and a narrow tip end on the side of the second end of the substrate, (b) a first grounding electrode connecting directly or via a gap to the rear end of the radiation electrode, (c) a second grounding electrode opposing the tip end of the radiation electrode via a gap, and (d) a feeding electrode formed on at least one surface of the substrate at a position facing an intermediate point of the radiation electrode, with or without contact with the radiation electrode.

One of the first and second grounding electrodes is preferably in contact with the radiation electrode, whereby the intensity of a radiating electric field decreases in a longitudinal direction of the radiation electrode and increases in a direction perpendicular thereto.

The chip antenna element preferably father comprises an extension electrode connected to the tip end of the radiation electrode and formed on a second end surface of the substrate and/or its nearby region on at least one side surface adjacent thereto. The extension electrode preferably is narrower than the tip end of the radiation electrode.

The insulating substrate is preferably in the form of a rectangular parallelepiped. Also, a ratio W/S of a width W of the wide rear end of the radiation electrode to a width S of the narrow tip end of the radiation electrode is preferably 2 or more, more preferably 2–5. The radiation electrode is preferably formed on adjacent side surfaces of the insulating substrate. Further, the feeding electrode is preferably located at a position deviating from a center of the substrate toward the tip end of the radiation electrode.

The antenna apparatus of the present invention comprises the above chip antenna element mounted onto a circuit board, the radiation electrode of the chip antenna element being in parallel with the edge of a ground conductor of the circuit board, and an open tip end of the radiation electrode being not close to the ground conductor.

There preferably is a gap between the grounding electrode of the chip antenna element and the ground conductor of the circuit board. The feeding electrode is preferably located at a position deviating from a center of the substrate of the chip antenna element toward the tip end of the radiation electrode. The feeding electrode preferably is connected to a feeding line disposed between a pair of ground conductors on the circuit board.

The communications apparatus of the present invention comprises the above antenna apparatus. The communications apparatuses of the present invention may preferably be cellular phones, headphones, personal computers, note-size personal computers, digital cameras, etc. comprising antennas for bluetooth devices.

BRIEF DESCRIPTION OF THE DRAWINGS

FIG. 3(*b*) is a view showing an equivalent circuit of a conventional chip antenna element;

FIG. 11(*b*) is a graph showing the relations between the width of a substrate and a bandwidth in the chip antenna element shown in FIG. 10;

FIG. 11(*c*) is a graph showing the relations between the dielectric constant of a substrate and a bandwidth in the chip antenna element shown in FIG. 10;

FIG. 19(*b*) is a perspective view showing an upper surface of a chip antenna element according to a still further embodiment of the present invention from an opposite angle;

FIG. 19(*c*) is a perspective view showing a lower surface of a chip antenna element according to a still further embodiment of the present invention;

FIG. 20(*b*) is a perspective view showing an upper surface of a chip antenna element according to a still further embodiment of the present invention from an opposite angle;

FIG. 20(*c*) is a perspective view showing a lower surface of a chip antenna element according to a still further embodiment of the present invention;

DESCRIPTION OF THE PREFERRED EMBODIMENTS

Figure 1:
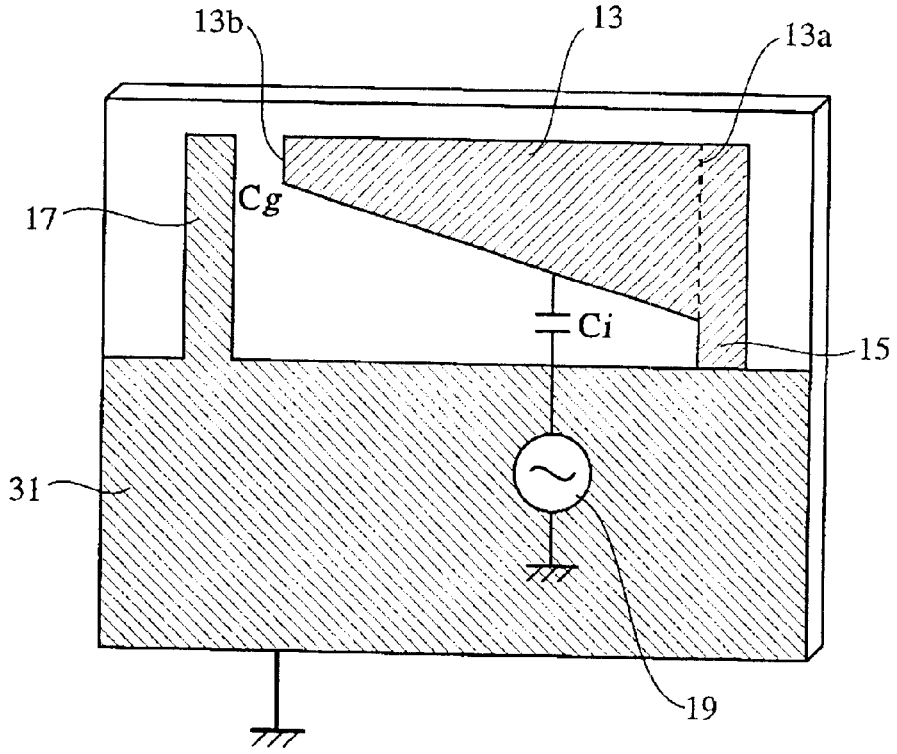
FIG. 1 is a perspective view showing a chip antenna element for explaining the principle of the present invention.
Figure 2:
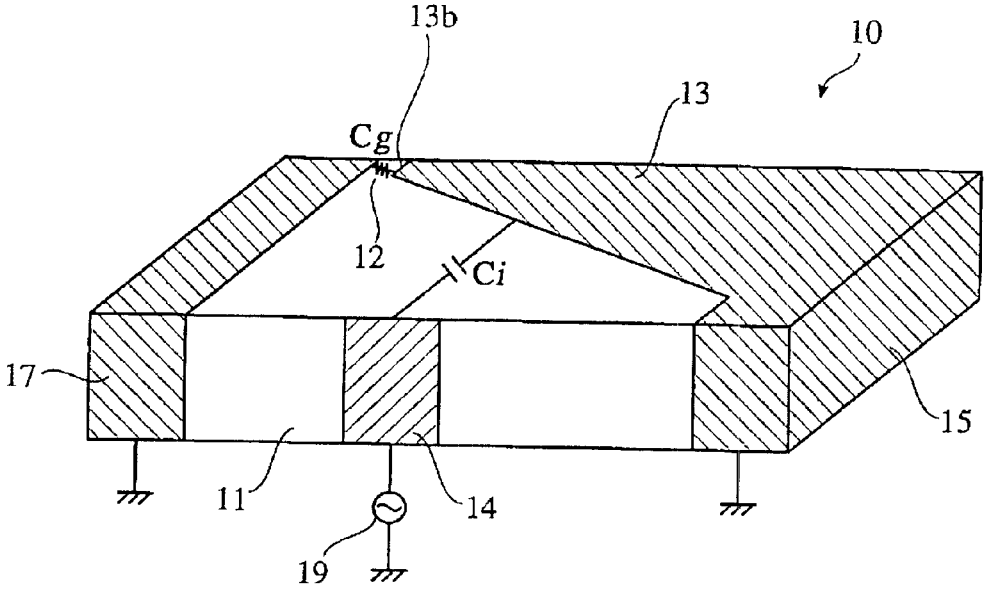
FIG. 2 is a perspective view showing a chip antenna element according to one embodiment of the present invention.

FIG. 1 shows a planar chip antenna element for explaining the principle of the present invention, and FIG. 2 shows a chip antenna element according to one embodiment of the present invention. In the planar chip 6 antenna element shown in FIG. 1, a radiation electrode 13 is gradually narrowing from a rear end 13*a* connected to a grounding electrode 15 connected to a ground conductor 31 to an open tip end 13*b* opposing a grounding electrode 17 extending from the ground conductor 31.

The chip antenna element 10 shown in FIG. 2 comprises an insulating substrate 11 substantially in the form of a rectangular parallelepiped; a grounding electrode 15 covering one end surface of the substrate 1 land its nearby surface region; a radiation electrode 13 formed as a microstrip conductor on an upper surface of the substrate 11, such that it is directly connected to the grounding electrode 15 and extends therefrom to the other end with a width continuously decreasing; and a feeding electrode 14 formed on the substrate 11 without contact with the radiation electrode 13, such that it feeds electric current to the radiation electrode 13 at an intermediate point. Though FIG. 2 shows a structure in which the grounding electrode 17 is opposite to the open tip end 13*b* of the radiation electrode 13 via a gap 12, this structure is not indispensable.

The important feature of the present invention is that the radiation electrode extends from a rear end to a tip end with a width decreasing substantially continuously and/or stepwise. The tip end of the radiation electrode is preferably in contact with the grounding electrode via a gap (in capacitance coupling). Also, the chip antenna element of the present invention is preferably mounted onto a circuit board, such that a gap between the tip end of the radiation electrode and the grounding electrode is distant from the ground conductor of the circuit board.

The width (in a direction perpendicular to a high-frequency electric current) of the radiation electrode 13 is not constant but gradually decreasing as nearing the gap 12. The high-frequency electric current fed from a feed source (high-frequency signal source) 19 via a feeding electrode 14 resonates at a frequency determined by the inductance of the radiation electrode 13 and the capacitance of a capacitor between the radiation electrode 13 and a ground, and emits to the space as an electromagnetic energy. In this case, there arises an electric current distribution mode having a node and an antinode at the grounding electrode 15 and the gap 12, respectively. If the radiation electrode 13 had a constant width, there would be only one electric current distribution mode. However, because the radiation electrode 13 extending between the grounding electrodes 15, 17 has a changing width, a plurality of electric current distribution modes are generated, equivalent to the formation of a plurality of resonance circuits. Because each resonance circuit has very close resonance frequency, the antenna element macroscopically provides resonance characteristics of wide bandwidth, resulting in decrease in the Q value of the antenna element.

Figure 3:
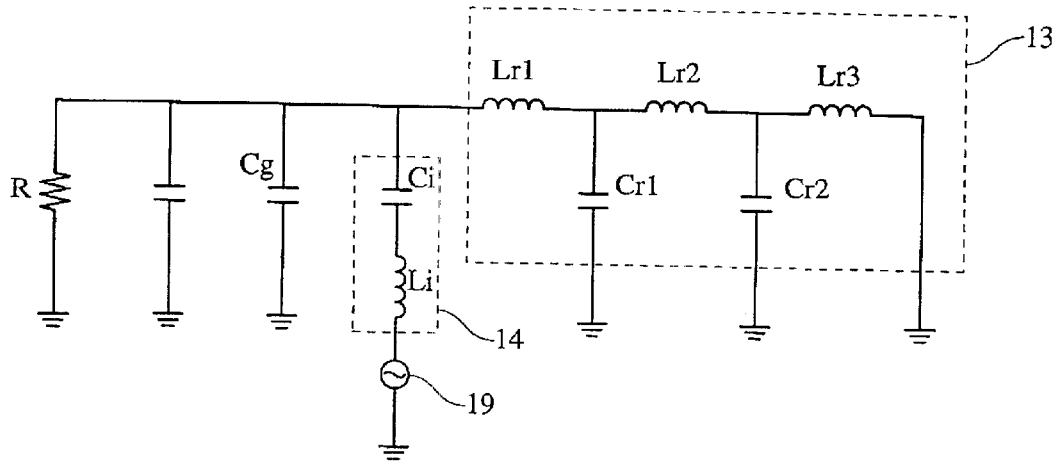
FIG. 3(*a*) is a view showing an equivalent circuit of the chip antenna element shown in FIG. 2.
Figure 3:
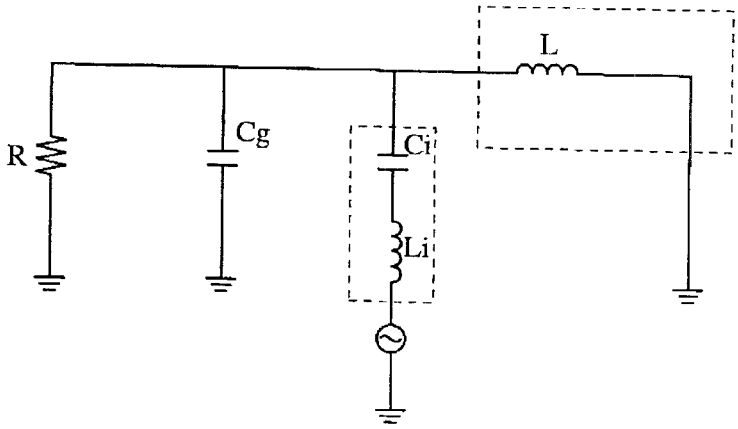

FIG. 3(*a*) shows an equivalent circuit of the chip antenna element of FIG. 2. A feed source 19 feeds electric current to a radiation electrode 13 via inductance Li and capacitance Ci generated by the feeding electrode 14, etc. The fed power is consumed by a radiation resistor R at resonance for emission to the space as electromagnetic wave. In the equivalent circuit, portions encircled by dotted lines are a radiation electrode 13 on the right side of the feed source 19, and a grounding electrode 17 and a gap 12 on the left side, with a capacitance Cg between the radiation electrode 13 and the grounding electrode 17.

FIG. 3(*b*) shows an equivalent circuit of the chip antenna element comprising a radiation electrode having a constant width. In this case, the radiation electrode can simply be represented by inductance L and capacitance C. On the other hand, in the case of the chip antenna element of the present invention comprising a radiation electrode having a changing width, the radiation electrode should be treated like a distributed constant. That is, the radiation electrode may be regarded as a combination of a large number of gradually changing inductance and a large number of gradually changing capacitance connected to each other. Accordingly, the equivalent circuit of the radiation electrode 13 is represented by a ladder circuit comprising a plurality of inductance Lr1, Lr2, Lr3, . . . and a plurality of capacitance Cr1, Cr2, . . . Because their resonance frequencies are extremely close to each other, it looks as if resonance takes place continuously, resulting in frequency characteristics of broad bandwidth.

Though the chip antenna element shown in FIG. 2 has a trapezoidal radiation electrode, the radiation electrode is not restricted to be trapezoidal but may be in any shape. The crux of the present invention is that in place of a radiation electrode having a constant width, a radiation electrode having a width gradually changing continuously and/or stepwise is used to provide an inductance distribution and a capacitance distribution, thereby constituting a plurality of resonance circuits, so-called parallel, multi-resonance circuits.

Figure 4:
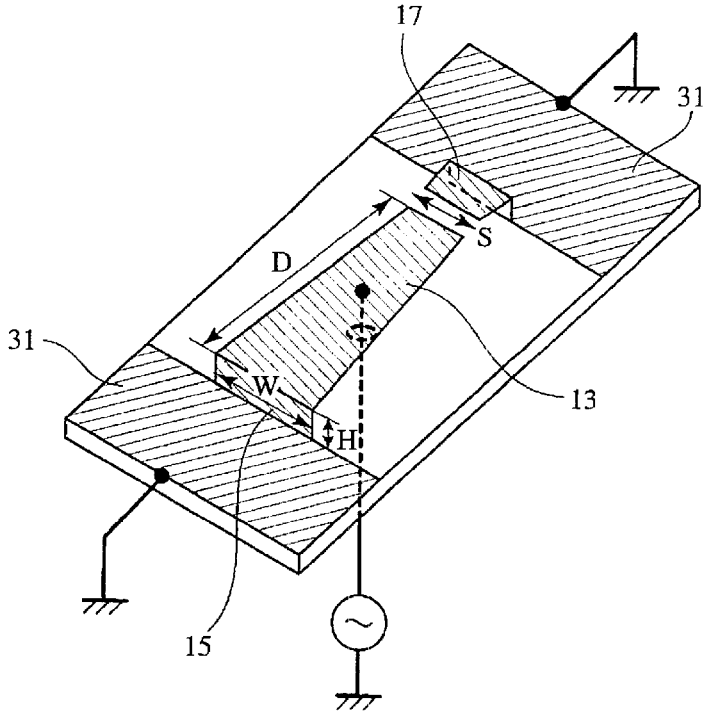
FIG. 4 is a perspective view showing the structure of a radiation electrode in the chip antenna element of the present invention.
Figure 5:
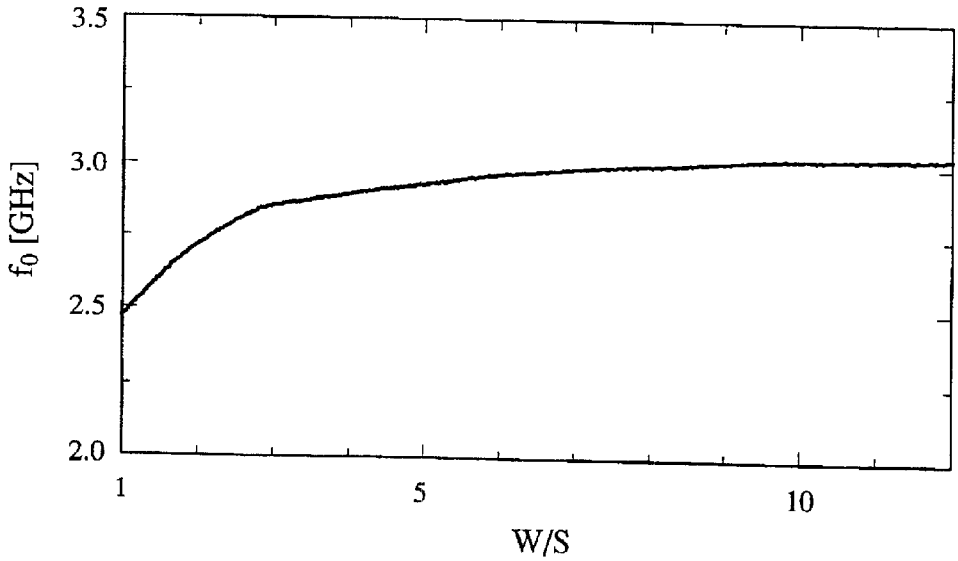
FIG. 5 is a graph showing the relations between a ratio W/S of the width W of a rear end of the radiation electrode to the width S of a tip end of the radiation electrode and a resonance frequency $f_0$ in the chip antenna element shown in FIG. 4.
Figure 6:
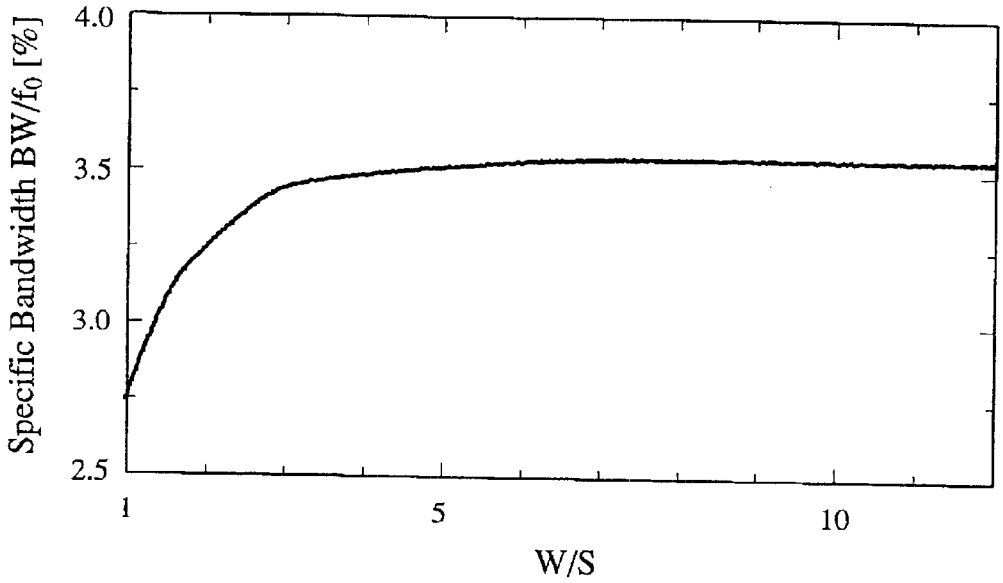
FIG. 6 is a graph showing the relations between a ratio W/S of the radiation electrode and a specific bandwidth $BW/f_0$.
Figure 7:
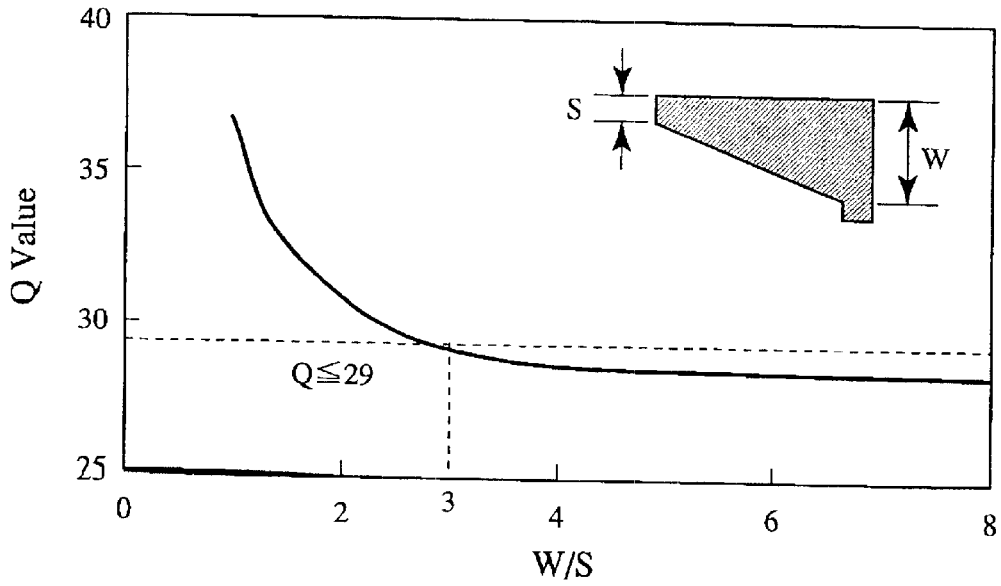
FIG. 7 is a graph showing the relations between W/S of the radiation electrode and a Q value in the chip antenna element shown in FIG. 4.

To know the influence of the shape of an radiation electrode on the characteristics of the chip antenna element, relations between W/S and various characteristics are investigated, in the trapezoidal radiation electrode shown in FIG. 4, which comprises a wide rear end having a width W, a narrow tip end having a width S, and a length D. FIG. 5 shows the relation between W/S and a resonance frequency $f_0$. When W/S exceeds about 5, the resonance frequency $f_0$ tends to be saturated. FIG. 6 shows the relation between W/S and a specific bandwidth $BW/f_0$. It is clear from FIG. 6 that when W/S becomes about 3 or more, the specific bandwidth $BW/f_0$ is saturated. FIG. 7 shows the relation between W/S and a Q value. As W/S increases, the Q value decreases, resulting in a wider bandwidth. When W/S is less than 2, the curve of the Q value is too steep to control. On the other hand, when W/S exceeds about 5, the Q value tends to be saturated. W/S meeting the condition of $Q \leqq 29$ is about 3 or more. The above results indicate that W/S is preferably 2 or more, more preferably 2–5.

If a radiation electrode is formed not only on an upper surface of the substrate but also on adjacent side surfaces of the substrate, the chip antenna element preferably is made smaller with improved radiation directivity. The tip end 13*b* of the radiation electrode 13 may be provided with an extension electrode extending to the second end surface and/or its nearby surface regions. The extension electrode functions as inductance or capacitance, making it easy to improve the radiation gain and control the frequency.

Figure 8:
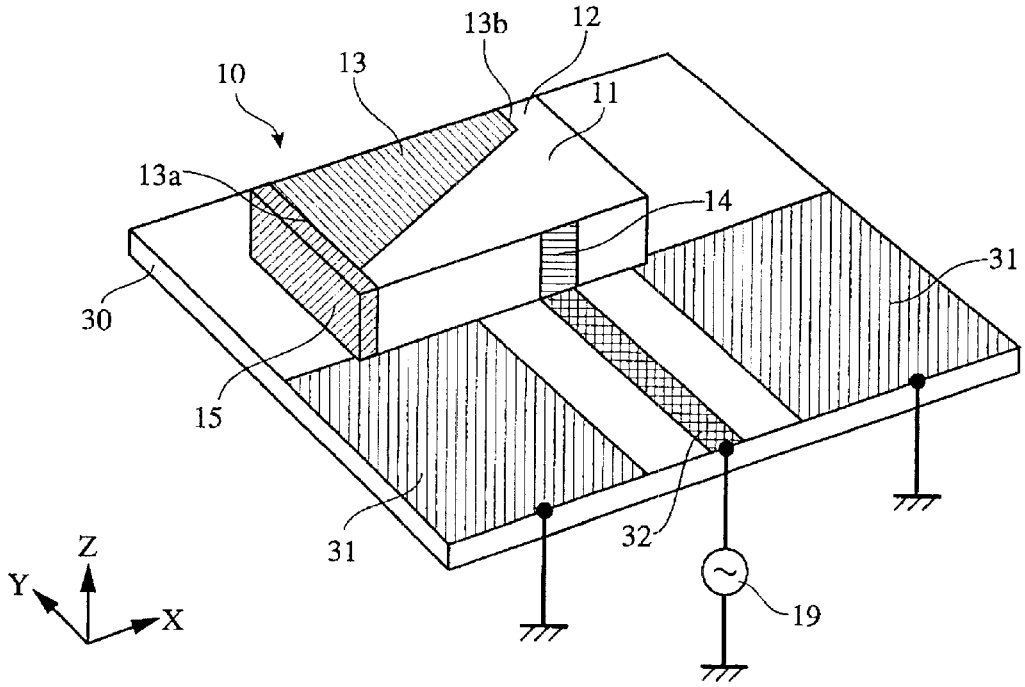
FIG. 8 is a perspective view showing an antenna apparatus comprising the chip antenna element of the present invention mounted onto a circuit board.

FIG. 8 shows an example in which the chip antenna element 10 of the present invention is mounted onto ground conductors 31, 31 of the circuit board 30. The insulating, rectangular parallelepiped substrate 11 is covered by the grounding electrode 15 on one end surface (first end surface) or its nearby surface regions, without ground electrode on a most area of the bottom surface. The feeding electrode 14 is formed on the substrate at a position of providing impedance matching. The grounding electrode 15 of the chip antenna element 10 is connected to the ground conductor 31 of the circuit board 30, and the feeding electrode 14 is connected to a feeding line 32 between the ground conductors 31, 31. The chip antenna element 10 is mounted onto the circuit board 30, such that a gap 12 between the tip end 13*b* of the radiation electrode 13 and the grounding electrode 17 is the most distant from the ground conductors 31, 31.

When the antenna emits a radio wave, electromagnetic energy is emitted to the space by an electromagnetic field generated between the radiation electrode 13 and the ground conductor 31, providing an extremely weak electromagnetic field at the grounding electrode 17 on the same voltage level as that of the ground conductor 31, and thus resulting in the radiation of extremely small electromagnetic energy.

Therefore, parts may be mounted onto the circuit board at positions near the antenna element. For this reason, it is possible to eliminate the influence of conductors of the casing and the circuit board, thereby preventing errors from occurring in the parts and thus improving the stability and reliability of the antenna characteristics.

Figure 9:
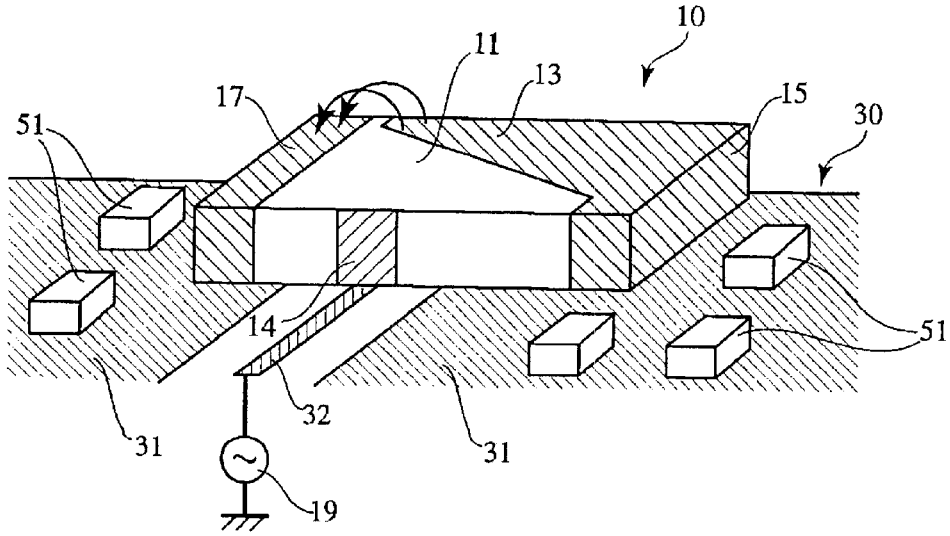
FIG. 9 is a perspective view showing an antenna apparatus comprising a chip antenna element of the present invention mounted onto another circuit board.

FIG. 9 shows a typical example of the antenna apparatus. Both grounding electrodes. 15, 17 of the antenna element 10 are connected to the ground conductors 31, 31 of the circuit board 30, with a feeding electrode 14 connected to a feeding line 32. The radiation electrode 13 is encircled by grounding electrodes 15, 17 at both lateral ends and the ground conductors 31, 31 at bottom, leaving an upper surface and two side surfaces of the antenna element 10 free from electrodes. Therefore, there is provided such a directivity that the intensity of an electromagnetic field radiated is low in the longitudinal direction of the radiation electrode 13 but high in the vertical direction of the radiation electrode 13, resulting in higher gain. Because the influence of an electromagnetic wave in the longitudinal direction of the radiation electrode 13 is reduced by shield effects of the grounding electrodes 15, 17, there is no problem of errors or malfunction even though parts 51 are mounted outside both end surfaces of the substrate 11 of the antenna element 10.

Figure 10:
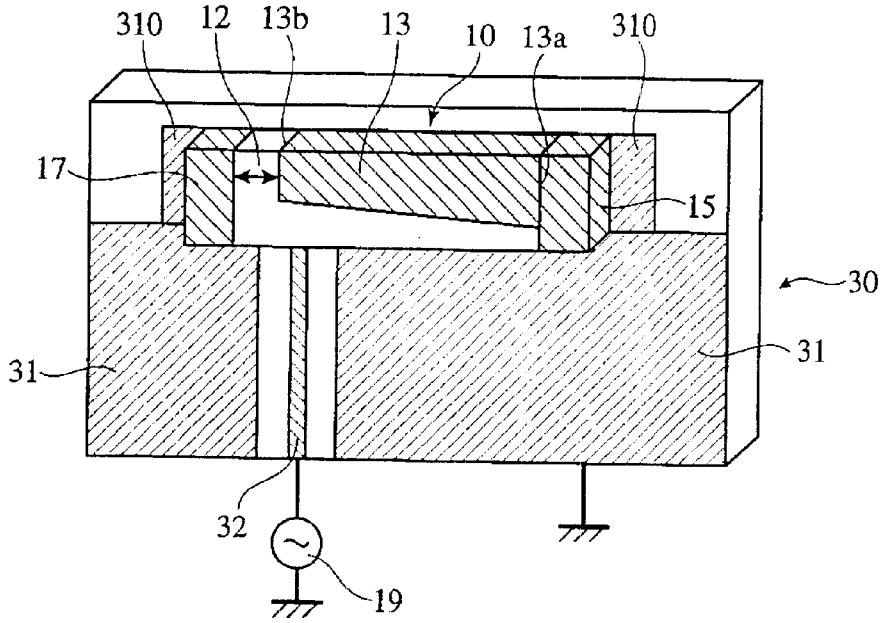
FIG. 10 is a perspective view showing an antenna apparatus comprising the chip antenna element of the present invention mounted onto another circuit board.

As shown in FIG. 10, the antenna element 10 is mounted onto ground conductors 31, 31 of the circuit board 30, such that the radiation electrode 13 is in parallel with the edges of the ground conductors 31, 31, in the present invention. Each grounding electrode 15, 17 is preferably connected to each ground conductor extension 310 extending from each ground conductor 31, and an electric field-radiating gap 12 between the radiation electrode 13 and the grounding electrode 17 is preferably located at the most distant position from the ground conductors 31, 31.

If image current generated in the ground conductors 31, 31 of the circuit board 30 by resonance current of the antenna element 10 has an opposite phase to that of current in the substrate 11, the radiation of an electromagnetic wave from the antenna element 10 is hindered, thereby likely causing decrease in gain and the shift of a resonance frequency. As shown in FIG. 10, if the radiation electrode 13 through which a resonance current most flows and the gap 12 are located at the most distant positions from the ground conductors 31, 31, an electromagnetic field can be generated at the most distant position from the ground conductors 31, 31, thereby remarkably reducing image current. Because a bottom surface of the insulating substrate 11 of the antenna element 10 is mostly free from grounding electrodes, image current is prevented from flowing through the ground conductor 31.

When the antenna element 10 is disposed such that it is perpendicular to the edges of the ground conductors 31, 31 as in conventional technologies, there is a large unoccupied space on the circuit board 30. On the other hand, when the antenna element 10 is disposed in parallel with the edges of the ground conductors 31, 31 as in the present invention, an area occupied by the antenna element 10 is drastically reduced, resulting in larger freedom of mounting layout and higher mounting density. When the antenna element 10 is disposed in parallel with the edges of the ground conductors 31, 31, decrease in gain should be compensated. For this purpose, the present invention utilizes the effects of the shape of the radiation electrode 13 and the arrangement of the grounding electrodes 15, 17. For instance, with the grounding electrode 15 covering all the end regions of the substrate 11, an electromagnetic field can be concentrated on a region ranging from the grounded rear end 13*a* of the radiation electrode 13 to the tip end 13*b* facing the gap 12. Further, the mounting of the feeding electrode 14 at an impedance-matching position connecting to the radiation electrode 13 with capacitance contributes to concentration of an electromagnetic field in the radiation electrode 13.

The reason why the radiation electrode 13 of the antenna element 10 is disposed in parallel with the edges of the ground conductors 31, 31 of the circuit board 30 is to obtain the maximum shape effect of the radiation electrode 13, thereby maximizing the function of a capacitor formed between the radiation electrode 13 and the ground surface. It is clear from FIGS. 9 and 10 that the function of a capacitor between the radiation electrode and the ground conductor is remarkably higher in the structure of the present invention, in which the radiation electrode 13 is disposed in parallel with the edges of the ground conductors 31, 31, than the conventional structure, in which the radiation electrode 13 is disposed in perpendicular to the edges of the ground conductors 31, 31.

Because the antenna element of the present invention radiates an electromagnetic field from a gap 12 between the radiation electrode 13 and the grounding electrode 17 not only in a radial direction around a longitudinal axis of the antenna element 10 but also in a direction perpendicular thereto, the antenna element can be omni-directional regardless of arrangement when mounted in a communications apparatus.

Figure 11A:
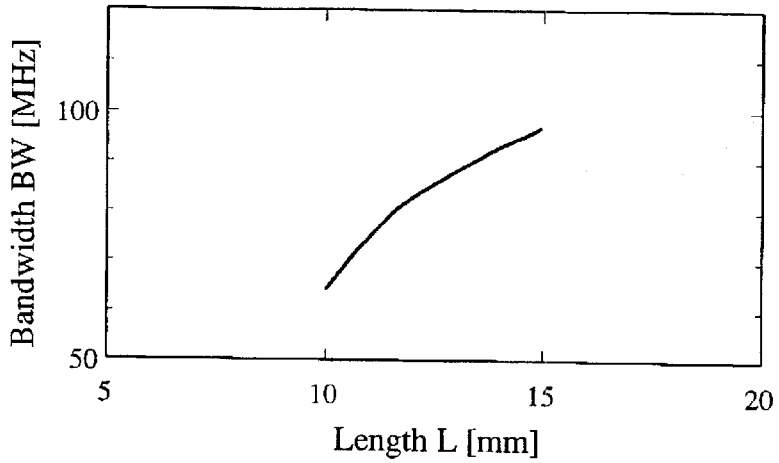
FIG. 11(*a*) is a graph showing the relations between the length of a substrate and a bandwidth in the chip antenna element shown in FIG. 10.
Figure 11B:
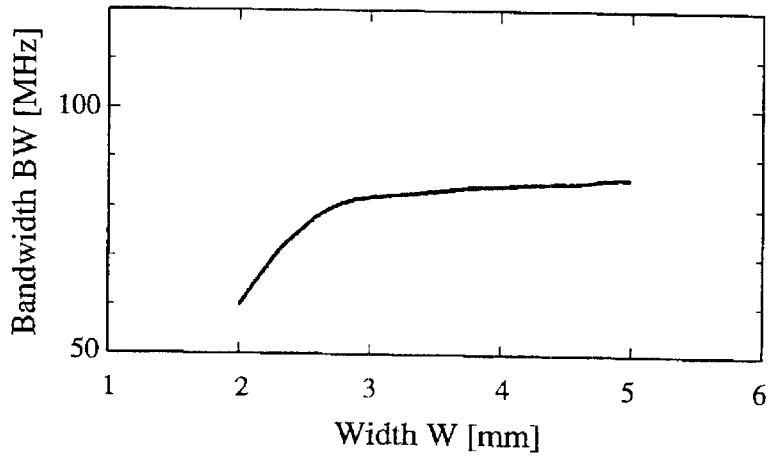
Figure 11C:
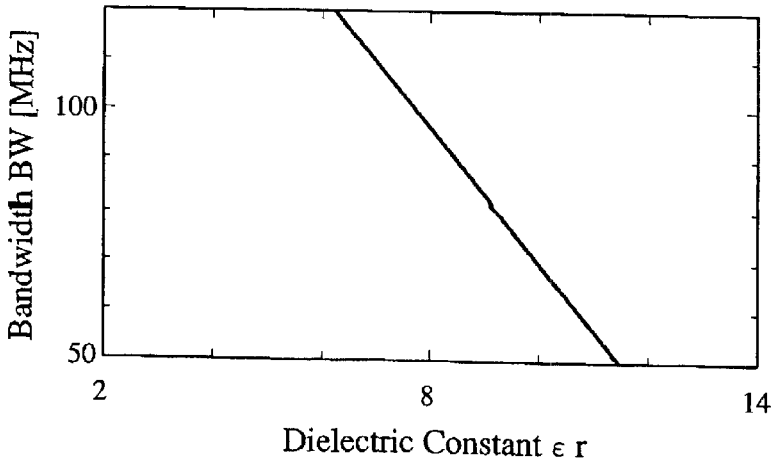

FIGS. 11(*a*)–(*c*) show the relations of a bandwidth BW of the antenna element with the size (length L and width W) and specific dielectric constant of the insulating substrate 11. Because the bandwidth BW changes depending on the size and material of the substrate 11, the present invention can efficiently be carried out by determining the relations of the size and material of the substrate 11 and bandwidth as shown in FIG. 11. It has been found that the insulating substrate 11 is preferably a rectangular parallelepiped body of 15 mm×3 mm×3 mm made of dielectric $Al_2O_3$ ceramic having a specific dielectric constant $\in r$ of 8. An electrode made of Ag was formed on the insulating substrate 11 as shown in FIG. 10. A radiation electrode 13 was substantially trapezoidal, and a ratio W/S of the width W of the rear end 13*a* to the width S of the tip end 13*b* was 3. Also, a 1-mm-long gap (insulating substrate-exposing portion) 12 was provided between an open tip end of the radiation electrode 13 and a grounding electrode 17. The rear end 13*a* of the radiation electrode 13 was directly connected to a grounding electrode 15. A feeding electrode 14 was formed on a side surface of the substrate at a position deviating from a center toward the gap. The antenna element 10 of the above size having a resonance frequency of 2.4–2.5 GHz, a bandwidth of 100 MHz, a specific bandwidth of 3.5%, a gain of −5 dBi or more and a voltage standing wave ratio VSWR of 3 or less was designed for cellular phones or wireless LAN required to be omni-directional.

The above-described embodiment is simply an example, which may properly be changed with respect to size and shape depending on design conditions. For instance, a columnar dielectric substrate may be used in place of the rectangular parallelepiped dielectric substrate, and substrate materials may be magnetic materials, resins or laminates thereof.

To expand the bandwidth or adjust the frequency, the gap or the radiation electrode is effectively trimmed. A rectangular slit (insulating substrate-exposing portion), which is provided on a slanting side of the radiation electrode 13 near an open end, can be trimmed to easily achieve matching.

The tip end 13*b* of the radiation electrode 13 should be opposite to the grounding electrode 17 via a gap 12, while the rear end 13*a* may be connected to the grounding electrode 15 directly or via a gap (capacity coupling).

What is necessary to suppress the radiation of an electromagnetic field from the end surfaces of the substrate 11 is to cover the end surfaces of the substrate 11 with grounding electrodes 15, 17 that are grounded. However, to ensure the effects of the grounding electrodes 15, 17, it is preferable to cover not only the end surfaces of the substrate 11 but also nearby regions on side surfaces adjacent to the end surfaces.

The feeding electrode 14 may be formed on a side surface or a side surface+an upper surface of the substrate 11 at a position facing the radiation electrode 13 with or without contact.

The antenna element 10 may be produced according to the following method. First, a dielectric ceramic block is cut to a plurality of rectangular parallelepiped chips, and worked to a predetermined size. The resultant dielectric chip is screen-printed with Ag electrodes (radiation electrode, grounding electrodes and feeding electrode) of predetermined shapes, and baked to provide a rectangular parallelepiped antenna element of 15 mm in length, 3 mm in width and 3 mm in thickness, for instance. The antenna element is preferably as thin as possible, and with the same thickness and width, anisotropy in a lateral direction disappears, making it easy to print electrodes.

Figure 12:
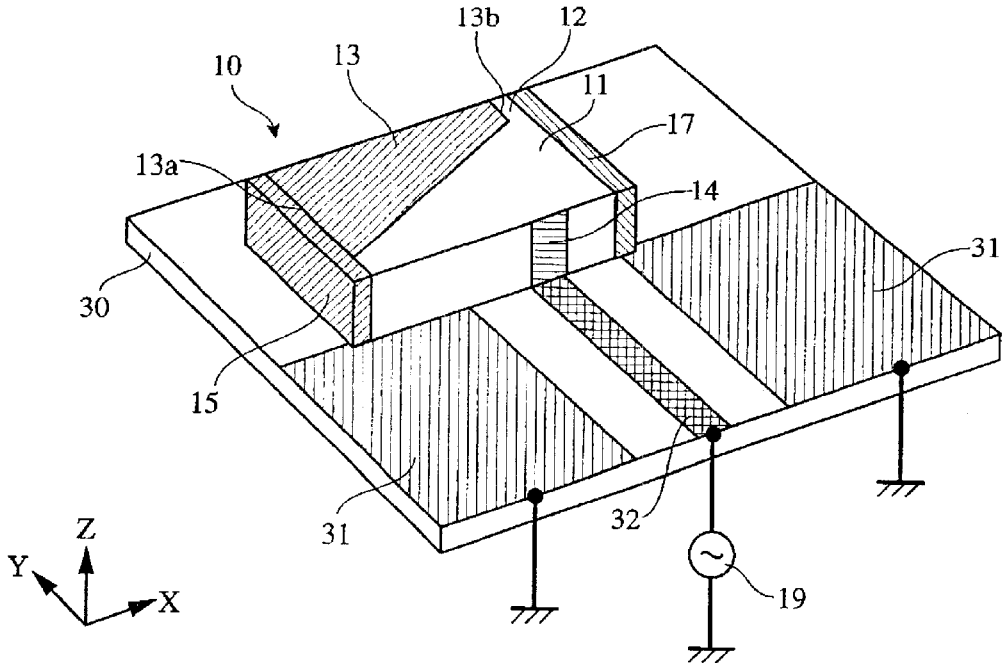
FIG. 12 is a perspective view showing a chip antenna element of the present invention to be evaluated.

FIG. 12 shows an antenna apparatus comprising an antenna element mounted onto a circuit board. The antenna element 10 is disposed along the edges of the ground conductors 31, 31 of the circuit board 30, with a feeding electrode 14 connected to a feeding line 32 connected to a feed source 19 located between both ground conductors 31, 31. The radiation electrode 13 has a wide rear end 13*a* on the side of the grounding electrode 15 and extends to a narrow tip end 13*b* with a width decreasing continuously. The gap 12 between the tip end 13*b* and the grounding electrode 17 is located at the most distant position from the ground conductors 31, 31. The feeding electrode 14 is located at a position deviating longitudinally from a center toward the gap 12, and a center of the antenna element 10 deviates from the center of the ground conductors 31, 31 accordingly.

The characteristics evaluated are a voltage standing wave ratio VSWR, directivity and gain. VSWR was determined by connecting a network analyzer to a feeder terminal and measuring impedance when viewed from the terminal side. The gain was calculated from power received by a reference antenna and the gain of a reference antenna, when power radiated from a test antenna was received by the reference antenna in an anechoic chamber. The directivity was determined by measuring the intensity of an electromagnetic field radiated in the same manner as the measurement of the gain, while rotating the antenna element disposed on a rotatable table.

Figure 13:
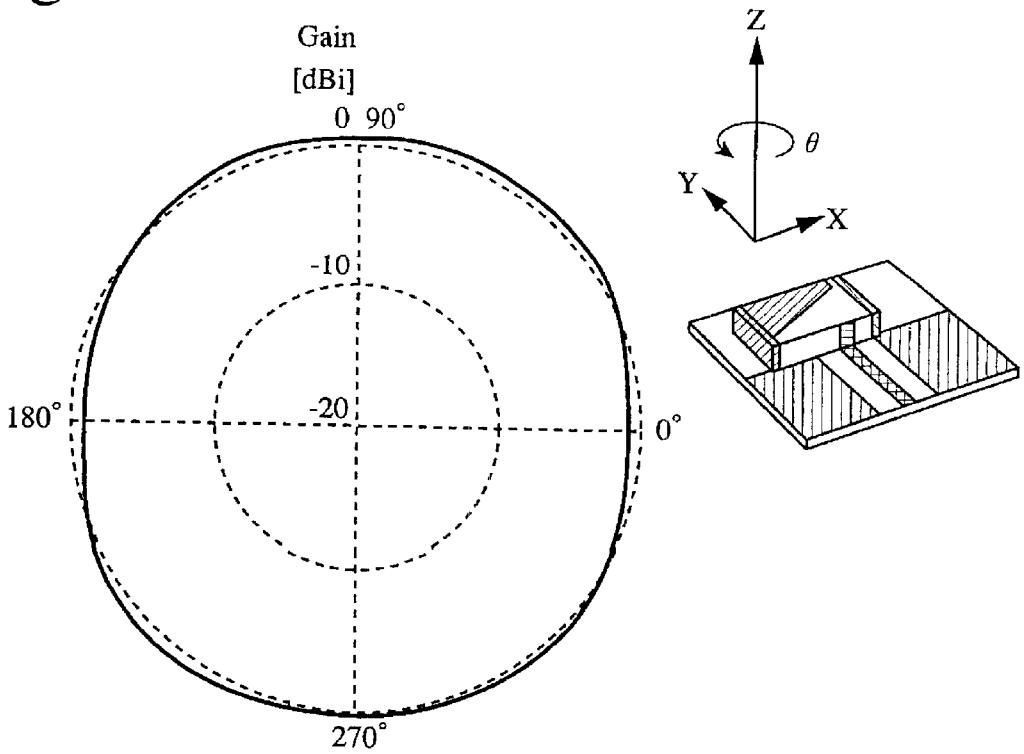
FIG. 13 is a graph showing the directivity of the chip antenna element of FIG. 12 with respect to a Z-axis.
Figure 14:
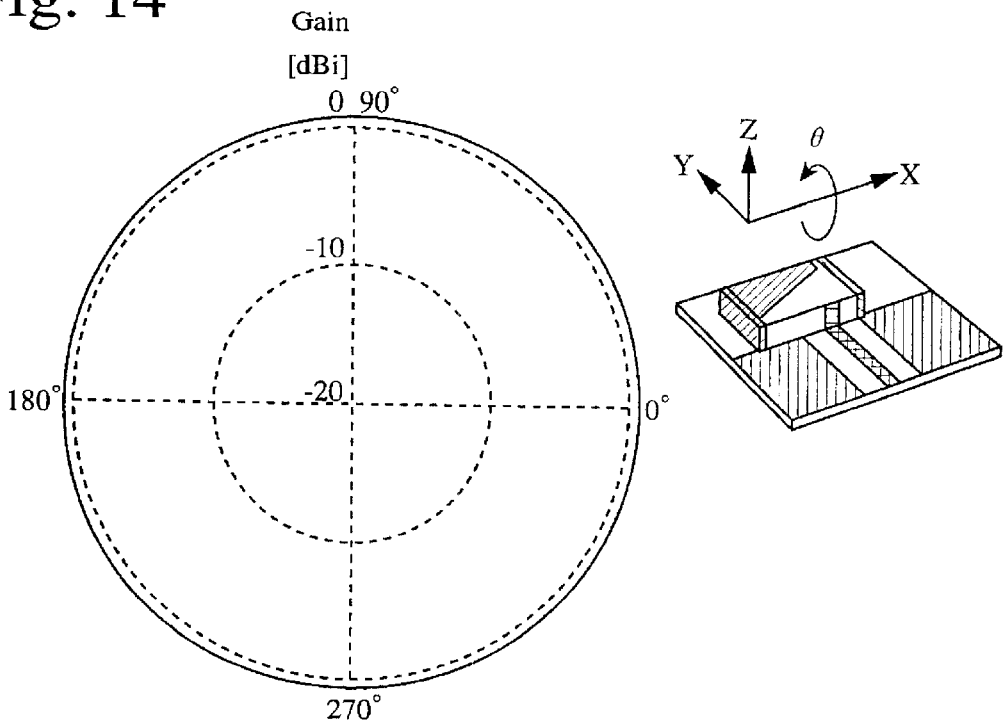
FIG. 14 is a graph showing the directivity of the chip antenna element of FIG. 12 with respect to an X-axis.
Figure 15:
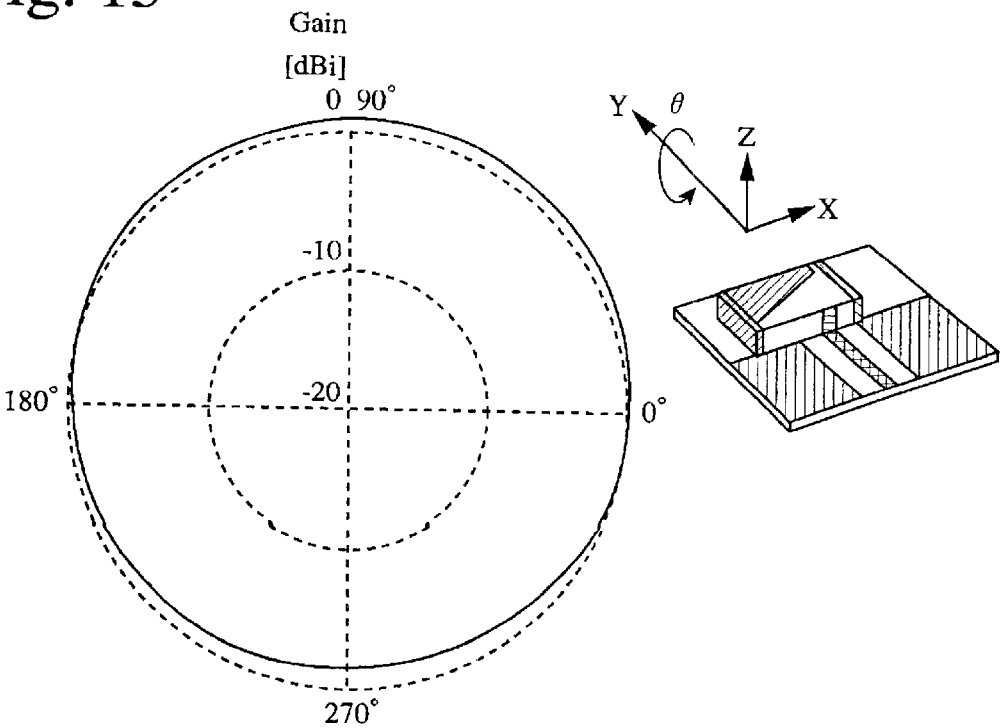
FIG. 15 is a graph showing the directivity of the chip antenna element of FIG. 12 with respect to a Y-axis.

FIGS. 13–15 show the directivity of the antenna element of FIG. 12 when rotated about an X-axis, Y-axis and Z-axis. As is clear from FIGS. 13–15, the graph of gain was substantially circle in any of the three directions, indicating that the antenna element was substantially omni-directional, though there was slight decrease in gain observed in the longitudinal direction of the antenna element. The reason therefor is that an electromagnetic field radiated in the longitudinal direction of the radiation electrode 13 was weakened.

Figure 16:
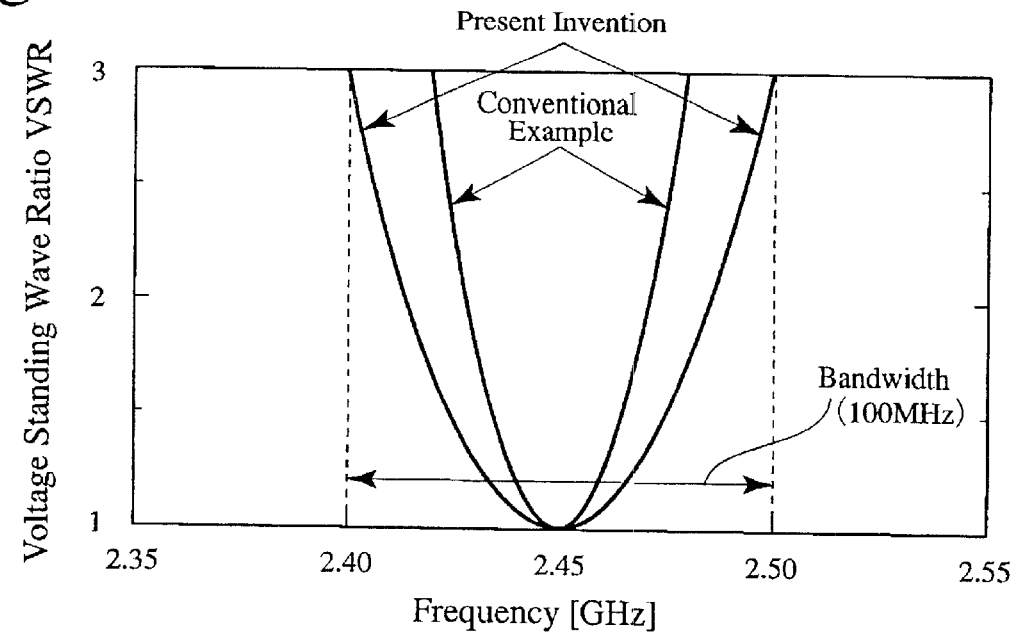
FIG. 16 is a graph showing the bandwidth characteristics of the chip antenna element of FIG. 12.

FIG. 16 shows the bandwidth of the antenna element 10 of FIG. 12. As compared to the conventional antenna elements, the antenna element of the present invention shown in FIG. 12 is remarkably improved in bandwidth. The bandwidth at a voltage standing wave ratio VSWR of 3 was 100 MHz.

The same measurement was carried out with the position of the feeding electrode 14 changing from a position shown in FIG. 12, at which it deviated from a center of the radiation electrode 13 toward the tip end 13*b*, to a center of the radiation electrode 13 and further to a position on the side of the rear end 13*a*, thus with the position of the antenna element 10 changing relative to the ground conductor 31. As a result, when the position of the feeding electrode 14 was changed from the position shown in FIG. 12, the antenna element 10 was poor in omni-directionality of bandwidth. This confirmed that the position of the feeding electrode 14 relative to the radiation electrode 13 and the position of the antenna element 10 relative to the ground conductor 31 had large influence on omni-directionality of bandwidth.

When the feeding electrode 14 for feeding electric current to an intermediate point of the radiation electrode 13 is not in contact with the radiation electrode 13, the feeding electrode 14 can have capacitance matching with the radiation electrode 13. Therefore, it can be disposed near the open tip end 13*b* having high impedance. On the other hand, when the feeding electrode 14 is in contact with the radiation electrode 13, matching is difficult because there is only inductance matching, making it inevitable to dispose the feeding electrode 14 on the side of the wide rear end 13*a* having low impedance.

Figure 17:
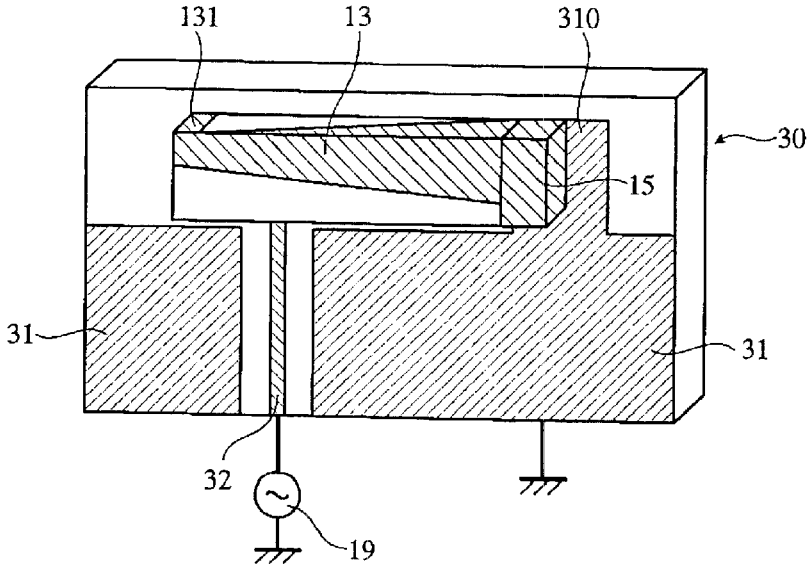
FIG. 17 is a perspective view showing a chip antenna element according to a further embodiment of the present invention.
Figure 18:
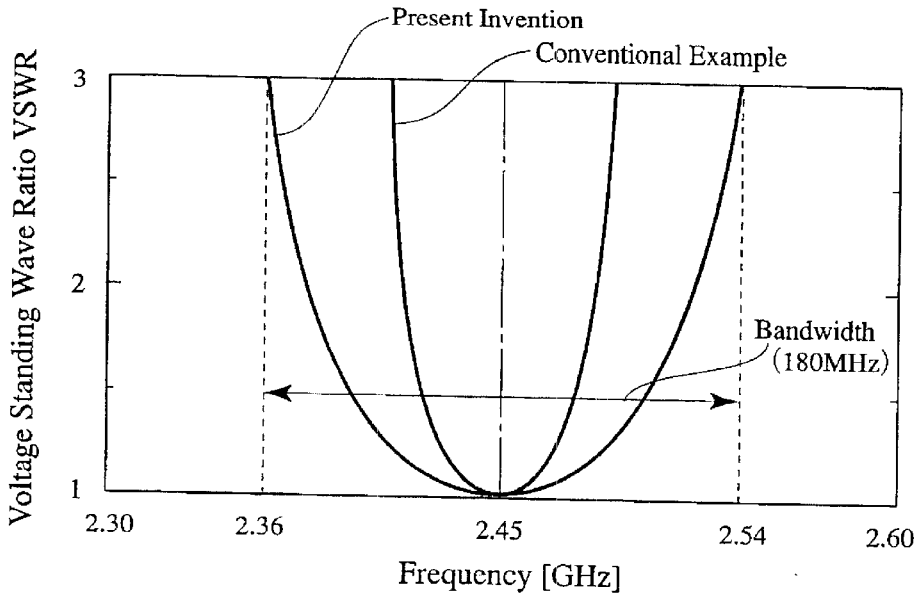
FIG. 18 is a graph showing the bandwidth of the chip antenna element of FIG. 17.

When a 2-mm gap is provided in the antenna element shown in FIG. 17, the bandwidth increased to 180 MHz at a voltage standing wave ratio VSWR of 3 as shown in FIG. 18. Even with no gap, the bandwidth was 120 MHz, achieving wider bandwidth than the conventional one. Though an occupied area slightly increases, the positioning of the radiation electrode 13 with a gap of about 2 mm from the ground conductor 31 is advantageous in bandwidth and radiation gain.

Figure 19A:
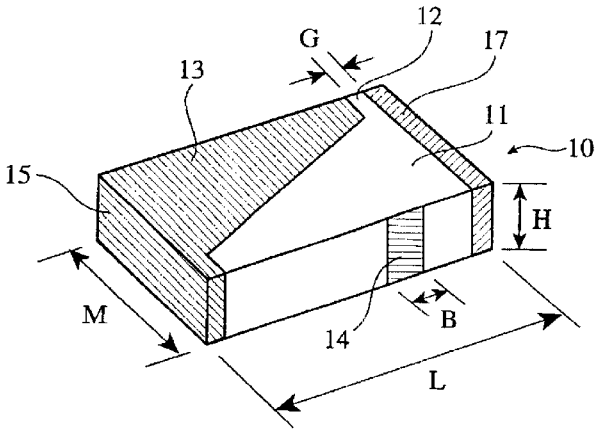
FIG. 19(*a*) is a perspective view showing an upper surface of a chip antenna element according to a still further embodiment of the present invention.
Figure 19B:
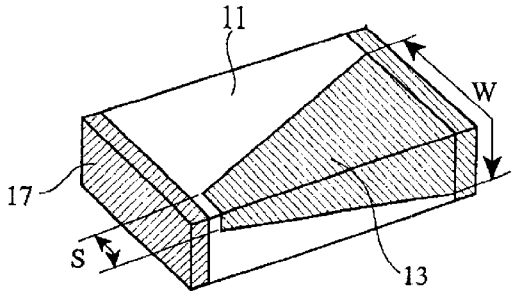
Figure 19C:
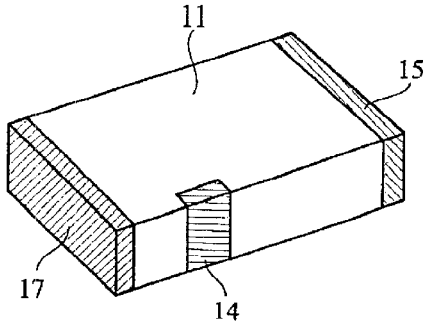
Figure 20A:
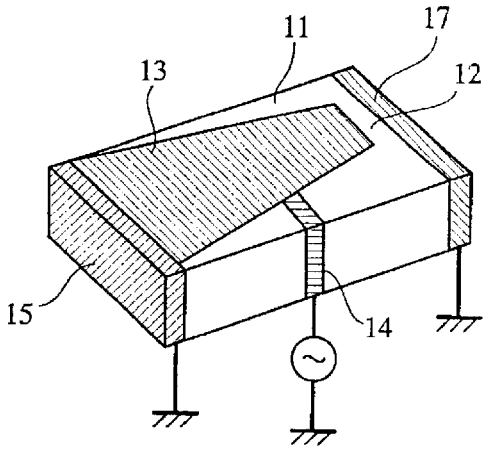
FIG. 20(*a*) is a perspective view showing an upper surface of a chip antenna element according to a still further embodiment of the present invention.
Figure 20B:
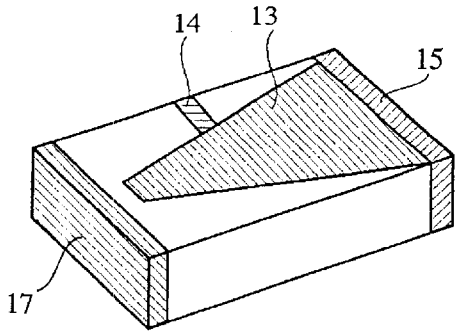
Figure 20C:
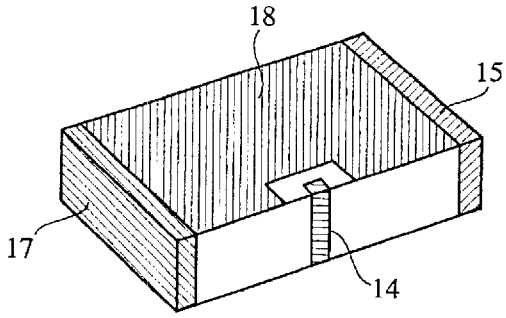

FIGS. 19 and 20 show another embodiment of the present invention. In the embodiment of FIG. 19, a radiation electrode 13 is disposed not only on an upper surface of the substrate 11 but also on adjacent side surfaces thereof. With this structure, the radiation electrode 13 is substantially widened, improving the omni-directionality of radiation gain, increasing the bandwidth, and achieving the miniaturization of the antenna element. The radiation electrode 13 may be extended to a lower surface of the insulating substrate 11. As is clear from FIG. 19(*c*), the grounding electrodes 15, 17 formed on both ends are not electrically connected.

The antenna element shown in FIG. 20 has a direct feeding system, in which a feeding electrode 14 is connected to a trapezoidal radiation electrode 13. Formed on a lower surface of the antenna element 10 is a conductor 18 connected to the grounding electrodes 15, 17.

Figure 21:
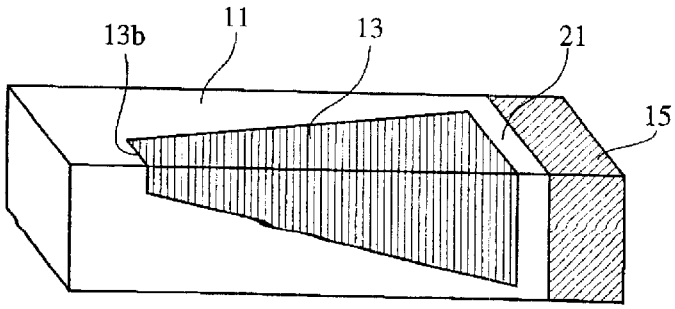
FIG. 21 is a perspective view showing a chip antenna element according to a still further embodiment of the present invention.
Figure 22:
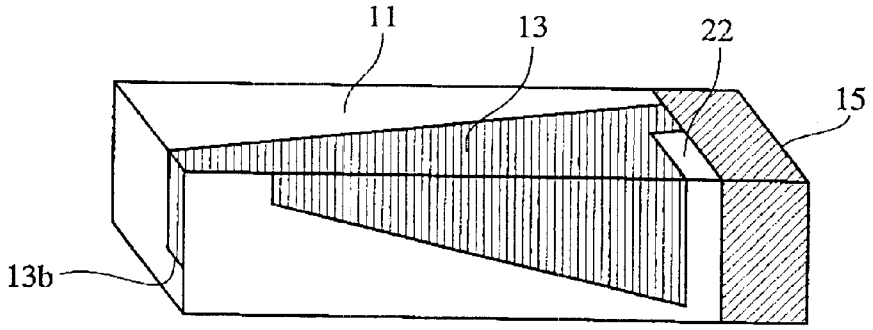
FIG. 22 is a perspective view showing a chip antenna element according to a still further embodiment of the present invention.
Figure 23:
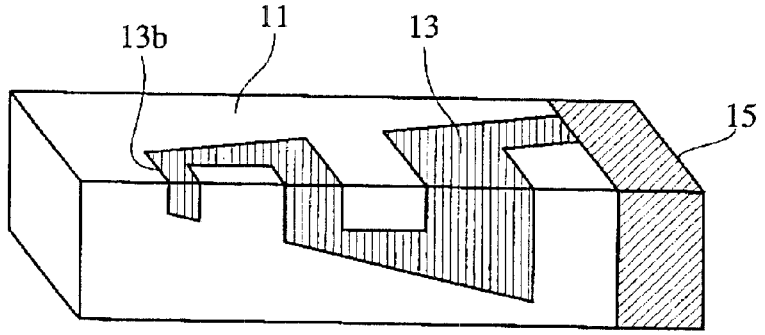
FIG. 23 is a perspective view showing a chip antenna element according to a still further embodiment of the present invention.

FIGS. 21–23 show thin antenna elements each having a length of 15 mm, a width of 3 mm and a height of 2 mm. These antenna elements have various radiation electrodes 13 each connected directly or via a gap to a grounding electrode 15 covering an end surface of the substrate 11 or its nearby surface region. The feeding electrode (not shown) is formed on a rear surface of the substrate. In these embodiments, the radiation electrode 13 is formed not only on an upper surface but also on adjacent side surfaces.

In the embodiment of FIG. 23, the radiation electrode 13 is meandering. With this structure, the radiation electrode 13 is substantially expanded, thereby providing improved radiation gain in a radial direction and broader bandwidth, and achieving further miniaturization.

In the embodiment shown in FIG. 21, there is a gap 21 between the radiation electrode 13 and the grounding electrode 15. Because the radiation electrode 13 is provided with gaps with grounding electrodes at both ends, an electromagnetic field generated from the gaps are spread widely, resulting in decrease in a Q value and thus broader bandwidth.

In the embodiment shown in FIG. 22, the radiation electrode 13 is partially connected to the grounding electrode 15. A slit (substrate-exposing portion) 22 is formed by trimming, and by changing the length and/or width of the slit 22, the resonance frequency of the antenna element can be adjusted. A tip end 13*b* of the radiation electrode 13 extends to the second end surface, and the resultant extension electrode can be used as an inductance component or a loaded capacitance component.

In the embodiment shown in FIG. 23, the radiation electrode 13 is formed in a meandering manner on two adjacent surfaces of the substrate 1. Because a resonance current flows through the meandering radiation electrode 13, the length of the meandering radiation electrode corresponds to about ¼ of electrical length. Accordingly, the radiation electrode can be made shorter, resulting in a further miniaturized antenna element.

Figure 24:
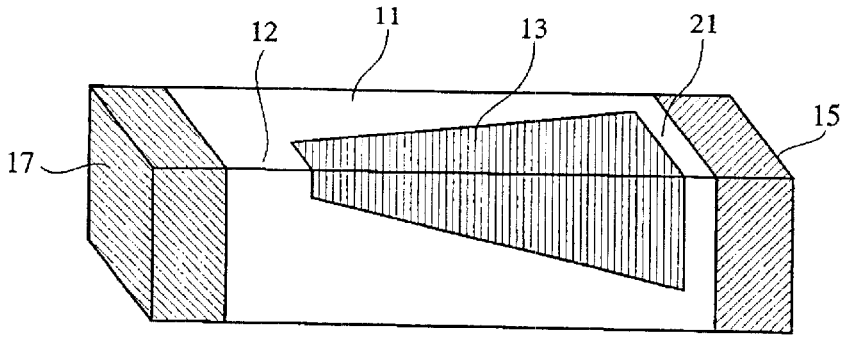
FIG. 24 is a perspective view showing a chip antenna element according to a still further embodiment of the present invention.
Figure 25:
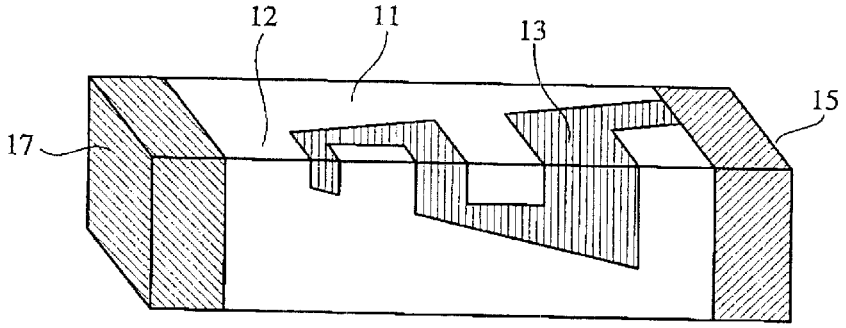
FIG. 25 is a perspective view showing a chip antenna element according to a still further embodiment of the present invention.
Figure 26:
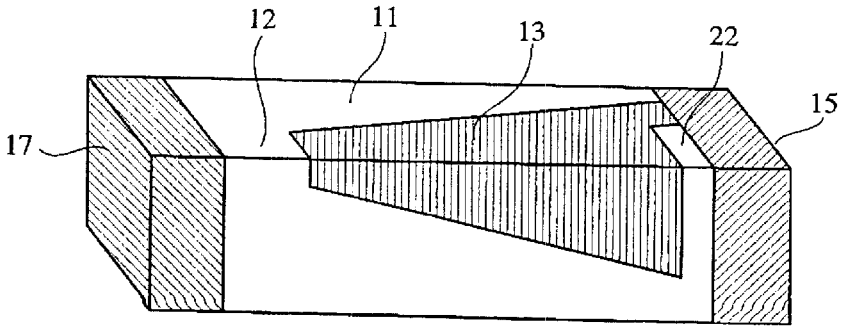
FIG. 26 is a perspective view showing a chip antenna element according to a still further embodiment of the present invention.

The antenna elements shown in FIGS. 24–26 are the same as those shown in FIGS. 21–23 except that they have grounding electrodes 17 facing tip ends of radiation electrodes 13 via gaps.

FIGS. 27–34 are developments showing antenna elements according to further embodiments of the present invention. In each figure, a hatched portion is an electrode.

Figure 27:
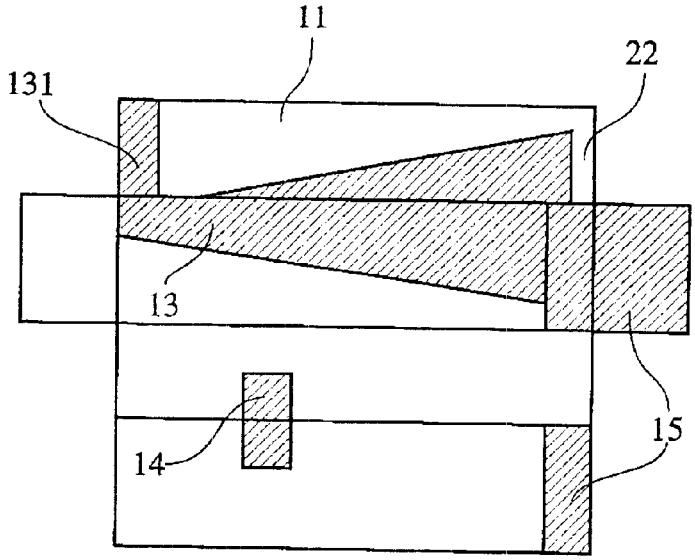
FIG. 27 is a development showing a chip antenna element according to a still further embodiment of the present invention.

The antenna element shown in FIG. 27 comprises a grounding electrode 15 formed on one end surface of the substrate 11 or its nearby surface region, a radiation electrode 13 formed on two adjacent surfaces of the substrate 11 such that it longitudinally extends from the grounding electrode 15 to the other end of the substrate 11 with a width decreasing, and an extension electrode 131 extending from the tip end of the radiation electrode 13 on an adjacent side surface. A feeding electrode 14 has impedance matching with the radiation electrode 13. the grounding electrode 15 is provided with a slit 22 for trimming, by which the frequency of the antenna element can be widely adjusted.

Figure 28:
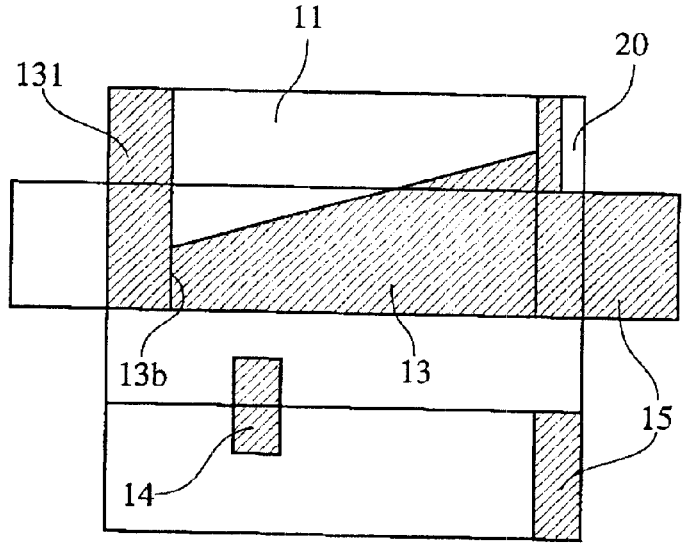
FIG. 28 is a development showing a chip antenna element according to a still further embodiment of the present invention.

The antenna element shown in FIG. 28 comprises a relatively wide extension electrode 131 for capacitance extending from the tip end 13*b* of the radiation electrode 13 on an upper surface and a side surface.

Figure 29:
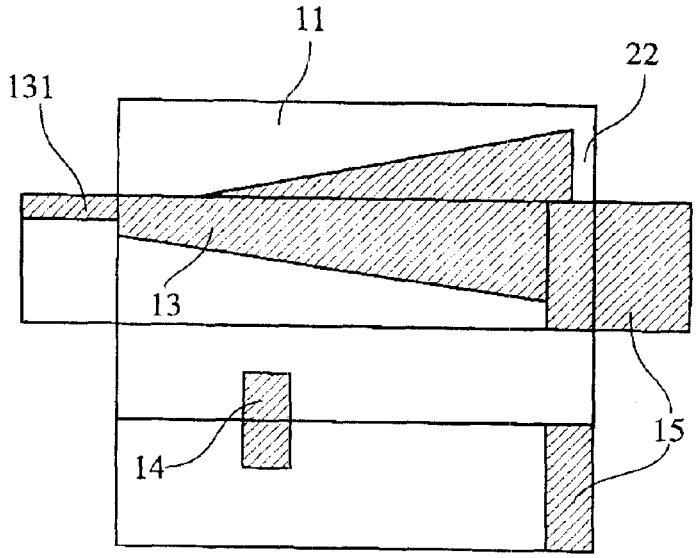
FIG. 29 is a development showing a chip antenna element according to a still further embodiment of the present invention.

The antenna element shown in FIG. 29 comprises an extension electrode 131 extending from the tip end of the radiation electrode 13 to the second end surface. The extension electrode 131 may be formed on the entire second end surface as a capacitance electrode.

Figure 30:
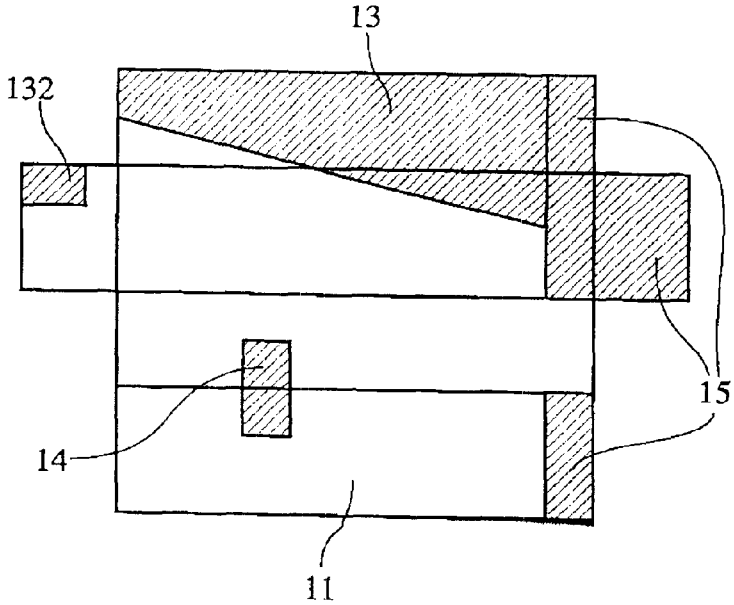
FIG. 30 is a development showing a chip antenna element according to a still further embodiment of the present invention.

The antenna element shown in FIG. 30 comprises a radiation electrode 13 extending on two adjacent surfaces, and a capacitance electrode 132 formed on the second end surface with a gap from the tip end of the radiation electrode 13.

Figure 31:
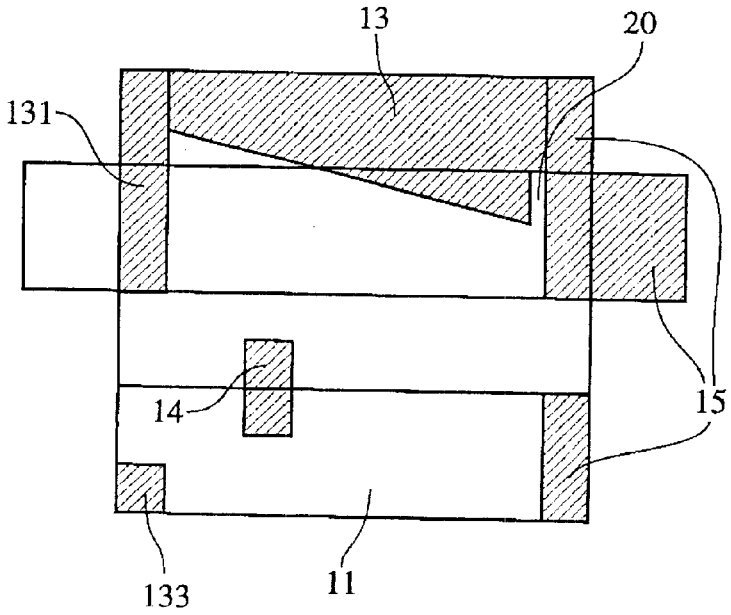
FIG. 31 is a development showing a chip antenna element according to a still further embodiment of the present invention.

The antenna element shown in FIG. 31 comprises a trimming portion 20 on one end of the radiation electrode 13, and an extension electrode 131 on the other end. With a dummy electrode 133 for soldering, the antenna element 10 is more strongly bonded to the circuit board 30.

Figure 32:
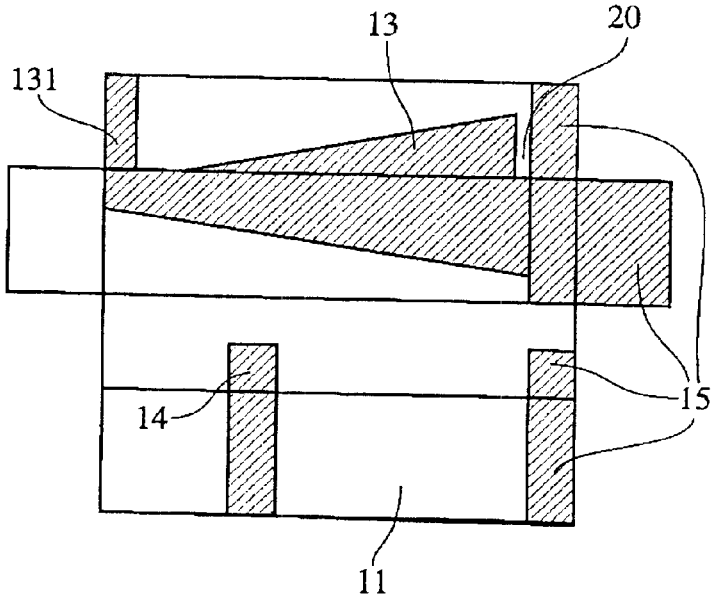
FIG. 32 is a development showing a chip antenna element according to a still further embodiment of the present invention.

The antenna element shown in FIG. 32 is the same as that shown in FIG. 27, except that the grounding electrode 15 is formed on the first end surface and its nearby surface region on four side surfaces, and that the feeding electrode 14 crosses the lower surface of the substrate 11. With this structure, a sufficient area for soldering can be obtained.

Figure 33:
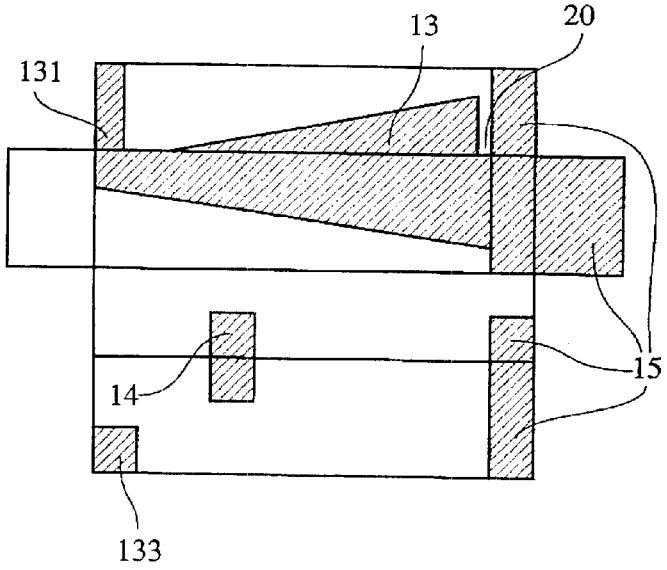
FIG. 33 is a development showing a chip antenna element according to still further embodiment of the present invention.

The antenna element shown in FIG. 33 is the same as that shown in FIG. 32, except that a dummy electrode 133 is formed on the lower surface of the substrate 11 instead of extending a feeding electrode 14 on the lower surface.

Figure 34:
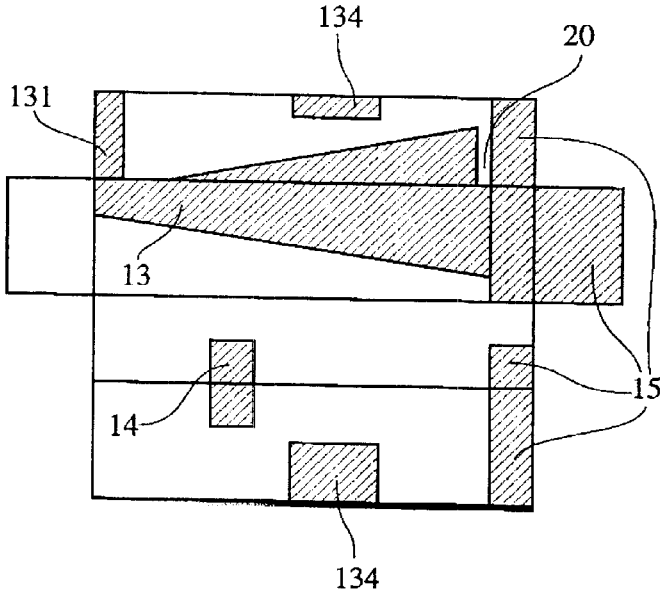
FIG. 34 is a development showing a chip antenna element according to a still further embodiment of the present invention.

The antenna element shown in FIG. 34 is the same as that shown in FIG. 32, except that it is provided with a floating electrode 134 on the lower surface of the substrate 11 without extending the feeding electrode 14. The floating electrode 134 increases capacitance between the radiation electrode 13 and a ground, making it easy to miniaturize the antenna element and adjust the frequency thereof.

Figure 35:
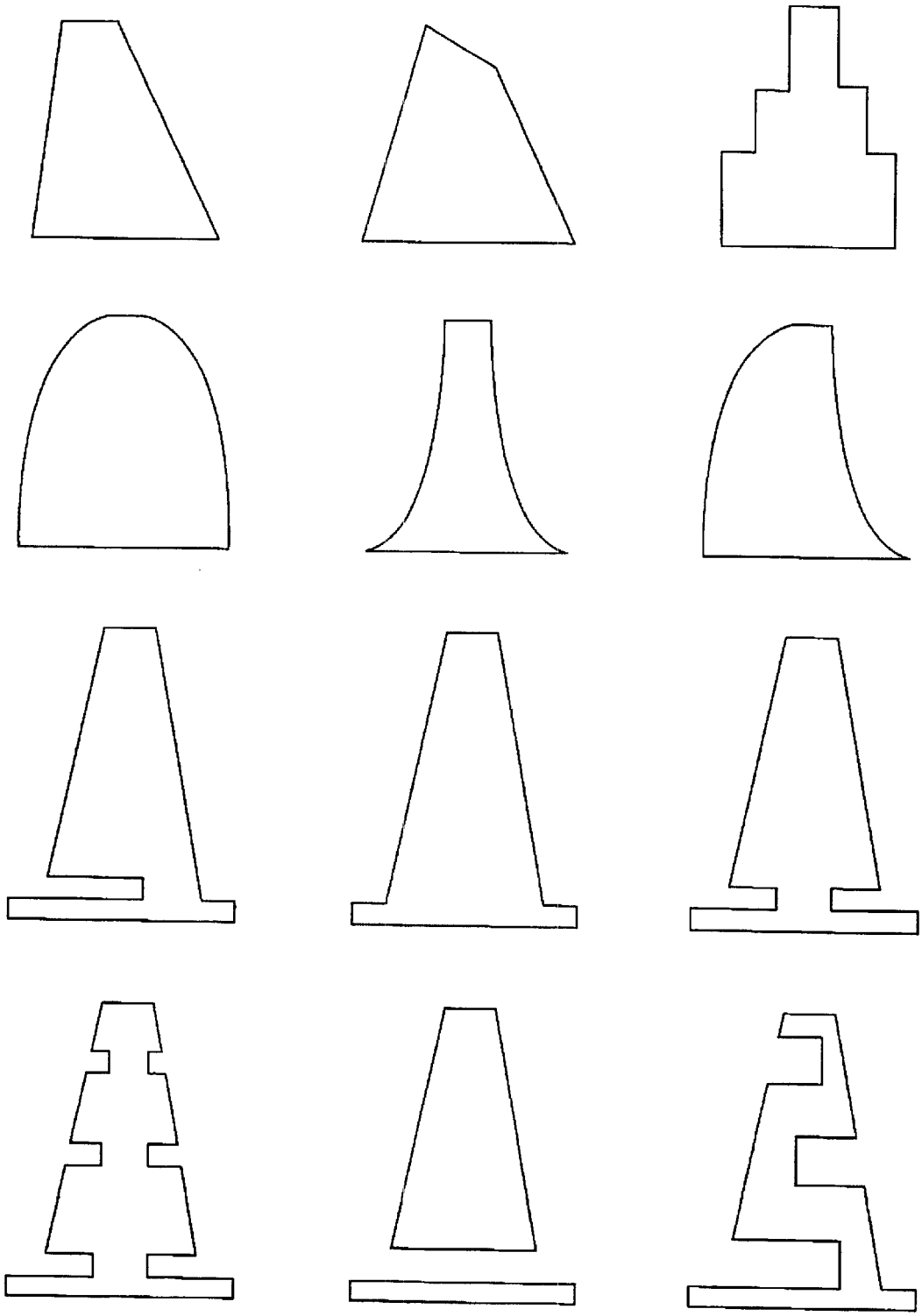
FIG. 35 is a view showing various shapes of radiation electrodes usable in the chip antenna element of the present invention.
Figure 36:
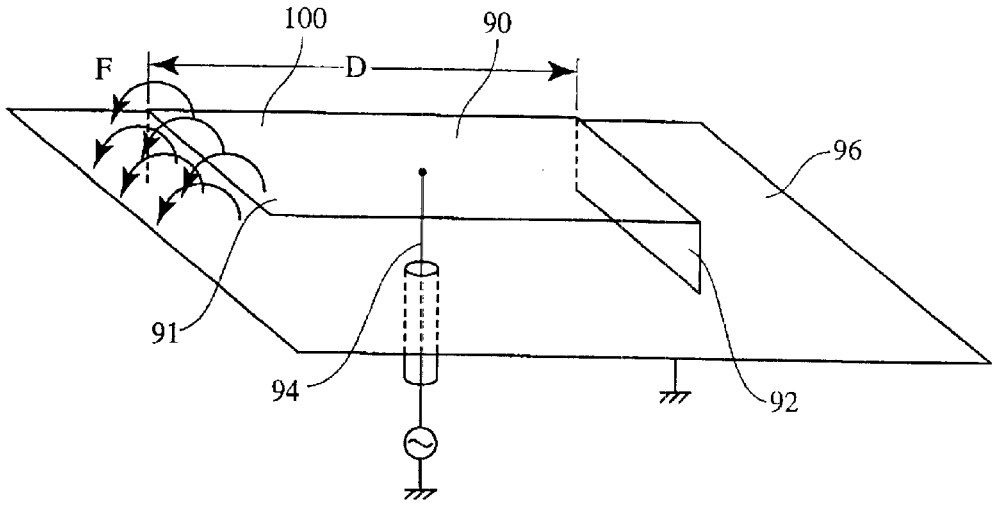
FIG. 36 is a schematic view showing an example of conventional microstrip-line antenna elements.

In addition to the above, the antenna element of the present invention may be provided with a radiation electrode having such a shape as shown in FIG. 35.

Though the dielectric substrate is made of insulating ceramics in the above embodiments, substrates made of resins may be used instead. In the case of a resin substrate, it may be provided with a through-hole for forming a feed point.

An antenna apparatus comprising the antenna element of the present invention mounted onto a circuit board may be assembled in a wireless communications apparatus such as a cellular phone, information terminal equipment, etc., to provide a substantially omni-directional communications apparatus having good antenna characteristics such as gain, bandwidth, etc. As a surface-mounting antenna element, the antenna element of the present invention can have high freedom in design with a small occupying area, providing high mounting density and thus miniaturizing an antenna apparatus and thus a communications apparatus comprising the antenna apparatus. In the antenna apparatus comprising an antenna element of 15 mm×3 mm×2–3 mm, for instance, the antenna element occupies an area of 50 $mm^2$ or less, ½ or less of a space in the conventional antenna apparatus.

As described above, the present invention provides a substantially omni-directional, small, high-performance chip antenna element having a wide bandwidth and a high gain and an antenna apparatus comprising such a chip antenna element. Because this antenna element occupies only an extremely small area on a circuit board to which it is mounted, a higher mounting density can be achieved. Accordingly, a portable communications apparatus comprising such an antenna apparatus can be miniaturized, exhibiting stable communications performance regardless of the position and direction of the apparatus.

What is claimed is:

1. A chip antenna element comprising (a) a grounding electrode formed on at least a first end surface at said first end of an insulating substrate, (b) a radiation electrode formed on at least one surface of said substrate, such that said radiation electrode extends from said grounding electrode with or without a gap to a second end of said substrate or its vicinity, with a width decreasing substantially continuously and/or stepwise, thereby having a wide rear end on the side of the first end of said substrate and a narrow tip end on the side of the second end of said substrate, and (c) a feeding electrode formed on at least one adjacent side surface of said substrate laterally with respect to a longitudinal direction of said radiation electrode, with or without contact with said radiation electrode.

2. The chip antenna element according to claim 1, further comprising an extension electrode connected to the narrow tip end of said radiation electrode and formed on a second end surface of said substrate and/or its nearby region on at least one side surface adjacent thereto.

3. The chip antenna element according to claim 1, wherein said insulating substrate is in the form of a rectangular parallelepiped.

4. The chip antenna element according to claim 1, wherein a ratio W/S of a width W of the wide rear end of said radiation electrode to a width S of the narrow tip end of said radiation electrode is 2 or more.

5. The chip antenna element according to claim 4, wherein the ratio W/S is 2–5.

6. The chip antenna element according to claim 1, wherein said radiation electrode is formed on adjacent side surfaces of said insulating substrate.

7. The chip antenna element according to claim 1, wherein said feeding electrode is located at a position deviating from a center of said substrate toward the tip end of said radiation electrode.

8. A chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a grounding electrode opposing a tip end of said radiation electrode via a gap, and (c) a feeding electrode formed on at least one adjacent side surface of said substrate laterally with respect to a longitudinal direction of said radiation electrode, with or without contact with said radiation electrode.

9. The chip antenna element according to claim 8, further comprising an extension electrode connected to the narrow tip end of said radiation electrode and formed on a second end surface of said substrate and/or its nearby region on at least one side surface adjacent thereto.

10. The chip antenna element according to claim 8, wherein said insulating substrate is in the form of a rectangular parallelepiped.

11. The chip antenna element according to claim 8, wherein a ratio W/S of a width W of the wide rear end of said radiation electrode to a width S of the narrow tip end of said radiation electrode is 2 or more.

12. The chip antenna element according to claim 8, wherein said radiation electrode is formed on adjacent side surfaces of said insulating substrate.

13. The chip antenna element according to claim 8, wherein said feeding electrode is located at a position deviating from a center of said substrate toward the tip end of said radiation electrode.

14. A chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a first grounding electrode connecting directly or via a gap to the rear end of said radiation electrode, (c) a second grounding electrode opposing the tip end of said radiation electrode via a gap, and (d) a feeding electrode formed on at least one adjacent side surface of said substrate laterally with respect to a longitudinal direction of said radiation electrode, with or without contact with said radiation electrode.

15. The chip antenna element according to claim 14, wherein one of said first and second grounding electrodes is in contact with said radiation electrode, whereby the intensity of a radiating electric field decreases in a longitudinal direction of said radiation electrode and increases in a direction perpendicular thereto.

16. The chip antenna element according to claim 14, further comprising an extension electrode connected to the narrow tip end of said radiation electrode and formed on a second end surface of said substrate and/or its nearby region on at least one side surface adjacent thereto.

17. The chip antenna element according to claim 14, wherein said insulating substrate is in the form of a rectangular parallelepiped.

18. The chip antenna element according to claim 14, wherein a ratio W/S of a width W of the wide rear end of said radiation electrode to a width S of the narrow tip end of said radiation electrode is 2 or more.

19. The chip antenna element according to claim 14, wherein said radiation electrode is formed on adjacent side surfaces of said insulating substrate.

20. The chip antenna element according to claim 14, wherein said feeding electrode is located at a position deviating from a center of said substrate toward the tip end of said radiation electrode.

21. An antenna apparatus comprising a chip antenna element mounted onto a circuit board, said chip antenna element comprising (a) a grounding electrode formed on at least a first end surface at said first end of an insulating substrate, (b) a radiation electrode formed on at least one surface of said substrate, such that said radiation electrode extends from said grounding electrode with or without a gap to a second end of said substrate or its vicinity, with a width decreasing substantially continuously and/or stepwise, thereby having a wide rear end on the side of the first end of said substrate and a narrow tip end on the side of the second end of said substrate, and (c) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

22. The antenna apparatus according to claim 21, wherein there is a gap between the grounding electrode of said chip antenna element and the ground conductor of said circuit board.

23. The antenna apparatus according to claim 21, wherein said feeding electrode is located at a position deviating from a center of said substrate of said chip antenna element toward the tip end of said radiation electrode, and wherein said feeding electrode is connected to a feeding line disposed between a pair of ground conductors on said circuit board.

24. An antenna apparatus comprising a chip antenna element mounted onto a circuit board, said chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a grounding electrode opposing a tip end of said radiation electrode via a gap, and (c) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

25. The antenna apparatus according to claim 24, wherein there is a gap between the grounding electrode of said chip antenna element and the ground conductor of said circuit board.

26. The antenna apparatus according to claim 24, wherein said feeding electrode is located at a position deviating from a center of said substrate of said chip antenna element toward the tip end of said radiation electrode, and wherein said feeding electrode is connected to a feeding line disposed between a pair of ground conductors on said circuit board.

27. An antenna apparatus comprising a chip antenna element mounted onto a circuit board, said chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a first grounding electrode connecting directly or via a gap to the rear end of said radiation electrode, (c) a second grounding electrode opposing the tip end of said radiation electrode via a gap, and (d) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

28. The antenna apparatus according to claim 27, wherein there is a gap between the grounding electrode of said chip antenna element and the ground conductor of said circuit board.

29. The antenna apparatus according to claim 27, wherein said feeding electrode is located at a position deviating from a center of said substrate of said chip antenna element toward the tip end of said radiation electrode, and wherein said feeding electrode is connected to a feeding line disposed between a pair of ground conductors on said circuit board.

30. A communications apparatus comprising an antenna apparatus comprising a chip antenna element mounted onto a circuit board, said chip antenna element comprising (a) a grounding electrode formed on at least a first end surface at said first end of an insulating substrate, (b) a radiation electrode formed on at least one surface of said substrate, such that said radiation electrode extends from said grounding electrode with or without a gap to a second end of said substrate or its vicinity, with a width decreasing substantially continuously and/or stepwise, thereby having a wide rear end on the side of the first end of said substrate and a narrow tip end on the side of the second end of said substrate, and (c) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

31. A communications apparatus comprising an antenna apparatus comprising a chip antenna element mounted onto a circuit board, said chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a grounding electrode opposing a tip end of said radiation electrode via a gap, and (c) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

32. A communications apparatus comprising an antenna apparatus comprising a chip antenna element mounted onto a circuit board, said chip antenna element comprising (a) a radiation electrode formed on at least one surface of said substrate, such that said radiation electrode extends from a first end of said substrate or its vicinity to a second end of said substrate or its vicinity, with a width decreasing substantially continuously and/or stepwise, thereby having a wide rear end on the side of the first end of said substrate and a narrow tip end on the side of the second end of said substrate, (b) a first grounding electrode connecting directly or via a gap to the rear end of said radiation electrode, (c) a second grounding electrode opposing the tip end of said radiation electrode via a gap, and (d) a feeding electrode formed on at least one adjacent side surface of said substrate laterally with respect to a longitudinal direction of said radiation electrode, with or without contact with said radiation electrode, said radiation electrode being in parallel with an edge of a ground conductor of said circuit board, and an open tip end of said radiation electrode being not close to said ground conductor.

* * * * *